US005496119A

United States Patent [19]

Kawakami et al.

[11] Patent Number: 5,496,119

[45] Date of Patent: Mar. 5, 1996

[54] TAPE PRINTER HAVING A DISPLAY

[75] Inventors: Yasushi Kawakami, Nagoya; Kazuaki Koie, Tokoname; Sachiyo Nakahigashi, Aichi; Kengo Omura, Toyoake; Shiro Yamada, Kasugai; Yasuyo Ooshio, Nagoya; Kazuko Ishida, Konan; Hideo Ueno, Nagoya; Minako Ishida, Aichi, all of Japan

[73] Assignee: Brother Kogyo Kabushiki Kaisha, Aichi, Japan

[21] Appl. No.: 365,101

[22] Filed: Dec. 28, 1994

[30] Foreign Application Priority Data

| | | | |
|---|---|---|---|
| Dec. 29, 1993 | [JP] | Japan | 5-351252 |
| Dec. 29, 1993 | [JP] | Japan | 5-351253 |
| Dec. 29, 1993 | [JP] | Japan | 5-351254 |

[51] Int. Cl.[6] ..... B41J 3/36

[52] U.S. Cl. ..... 400/70; 400/76; 400/615.2; 400/708; 395/102

[58] Field of Search ..... 400/61, 63, 70, 400/76, 615.2, 586, 708, 88; 395/102, 109, 110

[56] References Cited

U.S. PATENT DOCUMENTS 5,066,152 11/1991 Kazuya et al. .

5,188,469 2/1993 Nagao et al. .

FOREIGN PATENT DOCUMENTS 1-85050 6/1989 Japan .

2-106555 4/1990 Japan .

*Primary Examiner*—John S. Hilten

*Attorney, Agent, or Firm*—Oliff & Berridge

[57] ABSTRACT

After initialization (S1), the cassette signal is retrieved (S2). Then the tape width of the tape in the tape cassette mounted in the tape printer is determined by tape TB1 (S4). The width of the image display zone is calculated using the tape width and using the table TB5 (S7). The data of standard format information is stored in the start address of the text memory (S8). A text input screen is displayed set with the image display zone corresponding to the tape width calculated in S2 for the display. A cursor is also displayed having the size of the display character size, which was determined based on the print character size, which has been calculated using the tape width, the number of lines "1," and the table TB3. Accordingly, it is possible to provide a grasp of the relation between tape width and the situation at which characters will be printed.

12 Claims, 19 Drawing Sheets

FIG. 4

TB1

| CASSETTE SENSOR VALUE | TAPE WIDTH |
|---|---|
| 0000 | NO TAPE |
| 1010 | 6mm |
| 1000 | 9mm |
| 11XX | 12mm |
| 001X | 18mm |
| 01XX | 24mm |

NOTE:
X = 0
X = 1
OR

FIG. 5

TB2

| | |
|---|---|
| 7DOT CG (CHARACTER FONT) | |
| 10DOT CG (CHARACTER FONT) | |
| 16DOT CG (CHARACTER FONT) | |
| 21DOT CG (CHARACTER FONT) | |
| 32DOT CG (CHARACTER FONT) | |
| 24DOT CG (CHARACTER FONT) | |
| 48DOT CG (CHARACTER FONT) | |
| 64DOT CG (CHARACTER FONT) | |
| 96DOT CG (CHARACTER FONT) | |

DISPLAY FONT

PRINT FONT

FIG. 6

TB3

| TAPE WIDTH (mm) | PRINTABLE WIDTH (dots) | # OF LINES | PRINT CHARACTER SIZE (POINT VALUE : # OF DOTS) |
|---|---|---|---|
| 6 | 32 | 1 | 13pt : 32 |
| | | 2 | 6pt : 16 |
| 9 | 48 | 1 | 19pt : 48 |
| | | 2 | 10pt : 24 |
| | | 3 | 6pt : 16 |
| 12 | 56 | 1 | 19pt : 48 |
| | | 2 | 10pt : 24 |
| | | 3 | 6pt : 16 |
| 18 | 96 | 1 | 38pt : 96 |
| | | 2 | 19pt : 48 |
| | | 3 | 13pt : 32 |
| | | 4 | 10pt : 24 |
| | | 5 | 6pt : 16 |
| 24 | 96 | 1 | 38pt : 96 |
| | | 2 | 19pt : 48 |
| | | 3 | 13pt : 32 |
| | | 4 | 10pt : 24 |
| | | 5 | 6pt : 16 |

FIG. 7

TB4

| PRINT CHARACTER SIZE (pt) | DISPLAY CHARACTER SIZE (dots) | | |
|---|---|---|---|
| | BASE MAGNIFICATION RATE (X) | X 2 | X 3 |
| 6 | 7 | 10 | 16 |
| 10 | 7 | 16 | 21 |
| 13 | 10 | 21 | 32 |
| 19 | 16 | 32 | — |
| 26 | 21 | — | — |
| 38 | 32 | — | — |

FIG. 8

TB5

| TAPE WIDTH (mm) | | DISPLAY ZONE WIDTH DATA (dots) | | |
|---|---|---|---|---|
| | | BASE MAGNIFI-CATION RATE | X 2 | X 3 |
| NO TAPE | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| 6 | UPPER CUTOFF ZONE WIDTH | 8 | 3 | 0 |
| | IMAGE DISPLAY ZONE WIDTH | 16 | 26 | 32 |
| | LOWER CUTOFF ZONE WIDTH | 8 | 3 | 0 |
| 9 | UPPER CUTOFF ZONE WIDTH | 5 | 0 | 0 |
| | IMAGE DISPLAY ZONE WIDTH | 21 | 32 | 32 |
| | LOWER CUTOFF ZONE WIDTH | 6 | 0 | 0 |
| 12 | UPPER CUTOFF ZONE WIDTH | 4 | 0 | 0 |
| | IMAGE DISPLAY ZONE WIDTH | 24 | 32 | 32 |
| | LOWER CUTOFF ZONE WIDTH | 4 | 0 | 0 |
| 18 | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| 24 | UPPER CUTOFF ZONE WIDTH | 0 | 0 | 0 |
| | IMAGE DISPLAY ZONE WIDTH | 32 | 32 | 32 |
| | LOWER CUTOFF ZONE WIDTH | 0 | 0 | 0 |
| RE-MARKS | 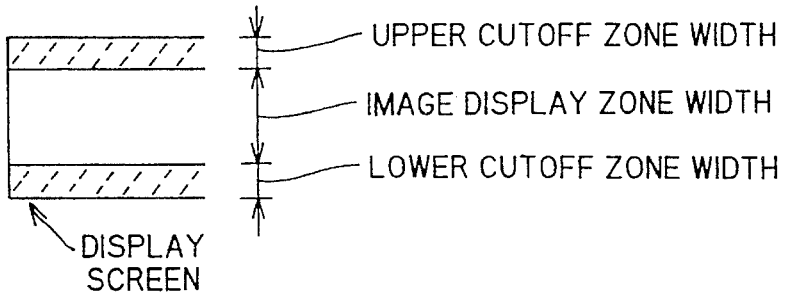 | | | |

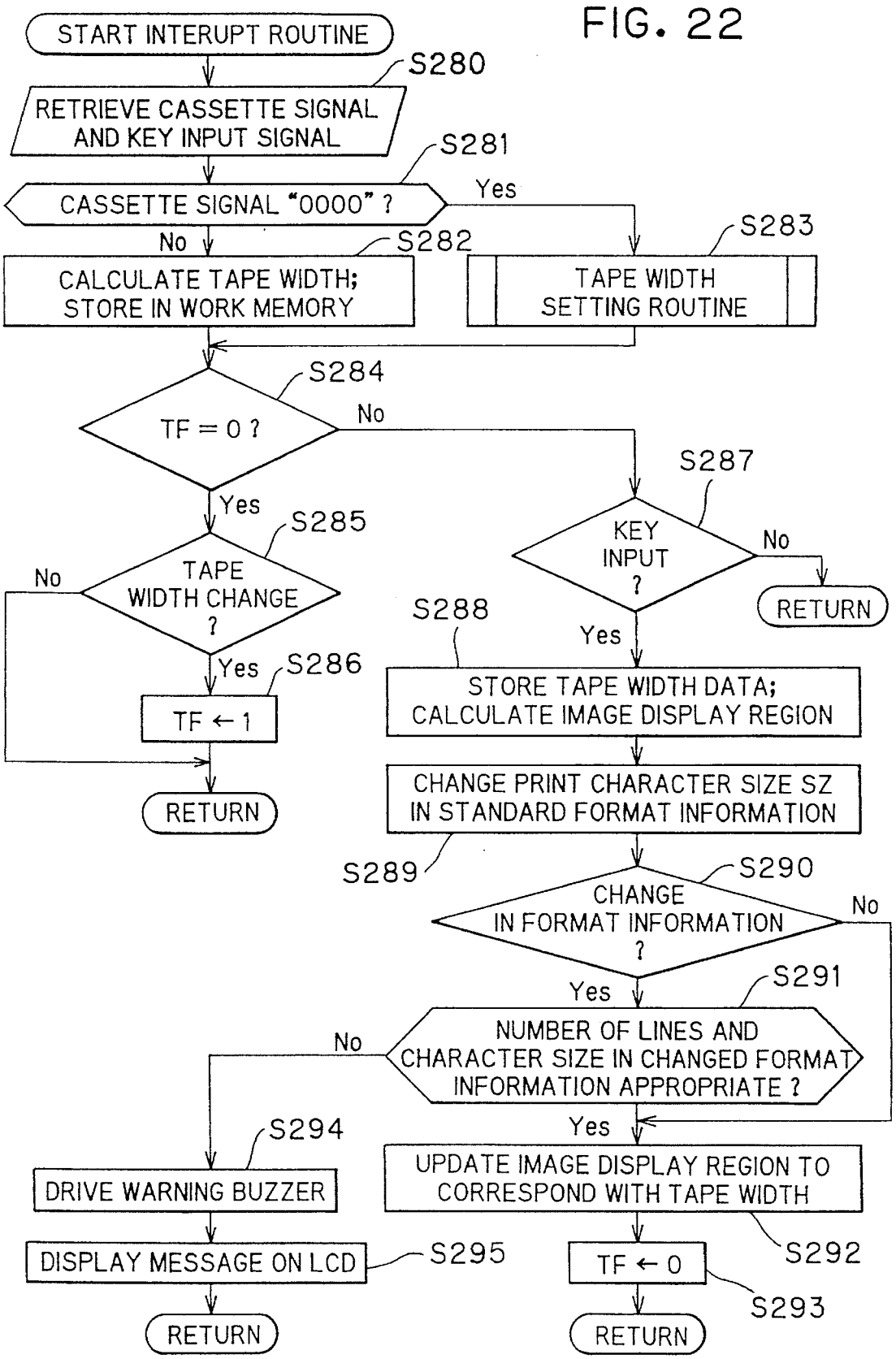
FIG. 22
START INTERUPT ROUTINE
S280
RETRIEVE CASSETTE SIGNAL AND KEY INPUT SIGNAL
S281
CASSETTE SIGNAL "0000" ?
Yes
No
S282
CALCULATE TAPE WIDTH; STORE IN WORK MEMORY
S283
TAPE WIDTH SETTING ROUTINE
S284
TF = 0 ?
No
Yes
S285
TAPE WIDTH CHANGE ?
No
Yes
S286
TF ← 1
RETURN
S287
KEY INPUT ?
No
RETURN
Yes
S288
STORE TAPE WIDTH DATA; CALCULATE IMAGE DISPLAY REGION
CHANGE PRINT CHARACTER SIZE SZ IN STANDARD FORMAT INFORMATION
S289
S290
CHANGE IN FORMAT INFORMATION ?
No
Yes
S291
NUMBER OF LINES AND CHARACTER SIZE IN CHANGED FORMAT INFORMATION APPROPRIATE ?
No
Yes
S294
DRIVE WARNING BUZZER
DISPLAY MESSAGE ON LCD
S295
RETURN
UPDATE IMAGE DISPLAY REGION TO CORRESPOND WITH TAPE WIDTH
S292
TF ← 0
S293
RETURN

TAPE PRINTER HAVING A DISPLAY

BACKGROUND OF THE INVENTION

1. Field of the Invention

The present invention relates to a tape printer for printing characters, such as symbols and letters, on a tape printing medium.

2. Description of the Related Art

U.S. Pat. No. 5,066,152 has proposed a tape print. The tape printer includes a keyboard, a display, and a printing mechanism. The tape printer is capable of printing characters, such as letters and symbols, on tapes in widths of 6 mm, 9 mm, 12 mm, 18 mm, 24 mm, and so on. The tape printer is a practical device for producing tape-shaped labels for adhering to the backbone of folders and the like. The tape printer includes a variety of editing functions.

It is possible to change the width of the tape to be printed on by replacing the tape cassette presently housed in the tape printer with a different tape cassette holding a tape with the desired width. The tape printer will print characters to a size to correspond to-the width of the housed tape.

SUMMARY OF THE INVENTION

It can be conceivable that a tape printer may be provided with a special display mode wherein images of characters are displayed on the display in the same form as the characters will appear in when printed out.

However, if characters are displayed on the display at a size that is unrelated to the width of the tape, there will be a problem in that an operator can not grasp how the characters will appear when printed on different width tapes even if characters are displayed on the display so as to appear the same as characters of the printed image. Also, if it is impossible to enlarge the size at which characters are displayed, when a plurality of rows are to be printed on a narrow width tape, characters must be displayed at such a small size that they become difficult to differentiate. This makes character input and other operations difficult to perform.

The tape printer can be constructed so that the displayed image changes according to the tape width detected by a tape width detection sensor. However, in the case where the tape width detection sensor indicates the width of the tape in the tape cassette mounted in the tape printer by producing ON and OFF signals, the displayed image will become distorted when the ON and OFF signals are changed by removing or exchanging the tape cassette.

If the font memory for storing various fonts of various characters includes a separate memory for font of displayed characters and a memory for font of printed characters, this will make the font memory expensive.

It is therefore an objective of the present invention to provide a tape print device wherein it is possible to obtain a grasp of the relation between the character print condition (that is, the condition of the image characters will be printed in) and the tape width.

Another object of the present invention is to allow display of characters at an enlarged size when necessary.

Still another object of the present invention is to allow display of a stable image that is maintained even during exchange of the tape cassette.

Still another object of the present invention is to decrease costs for-producing the font memory.

In order to attain the above objects and other objects, the present invention provides a tape printer for printing desired characters onto a tape, the tape printer comprising: input means for inputting characters desired to be printed on a tape and a variety of commands; data memory means for storing data of the inputted characters; a font memory for storing dot pattern data for a plurality of characters in a plurality of sizes; tape cassette receiving means for being detachably loaded with a tape cassette containing a tape; tape width detection means for detecting a tape width of the tape contained in the tape cassette loaded in the tape cassette receiving means; display data production means for receiving data on the detected tape width, for retrieving dot pattern data of a display size from the font memory means for the characters stored in the data memory means, the display size corresponding to the tape width, and for producing display dot image data representing an image of the inputted characters which appears the same when displayed as when printed; a display data buffer for storing the produced display dot image data; display means for receiving the display dot image data from the display data buffer and for displaying the image of the inputted characters; and printing means for printing the image of the inputted characters on the tape.

With this structure, the tape width detection means detects the width of the tape in the tape cassette, whereupon the display data production means receives data on the tape width of the tape in the tape cassette, retrieves dot pattern data of a display size, which corresponds to the tape width, from the font memory means for characters stored in the data memory means, and produces display dot image data for displaying an image which will appear the same as the printed out image. The display dot image data is developed in the display data buffer and displayed on the display. Therefore, characters can be displayed at a display size which corresponds to the tape width, so that the relation between the tape width and the condition at which characters will be printed becomes easy to grasp, thus improving ease with which the tape printer can be operated.

The tape printer may further comprise size enlarging setting means for setting an enlarged display size at which characters are to be enlarged when displayed, the display data production means retrieving from the font memory means dot pattern data of the enlarged display size which is set by the size enlarging setting means.

With this structure, the enlarged display size at which characters are to be enlarged for display is set using the size enlarging setting means. The display data production means retrieves dot pattern data of the enlarged display size for the set rate of enlargement from the font memory means. As a result, enlarged characters are displayed on the display. Therefore, when a narrow width tape is provided in the tape cassette, which would normally translate into characters being displayed at a small size, the display of characters can be enlarged as desired, thus improving the ease with which the tape printer can be operated.

In the tape printer, the display data production means may update the display dot image data when the tape width detected by the tape width detection means changes.

With this structure, the display data production means changes or updates the display dot image data when the tape width detected by the tape width detection means changes. For example, when the tape is changed for a tape with a larger width, characters are displayed at a larger size. Also, when the tape is changed for a tape with a narrower width, characters are displayed at a smaller size. That is, when the tape width detection means detects a change in the tape width, the display data production means automatically updates the display dot image data. Therefore, even when the tape is changed, characters can be certainly displayed at a display size which corresponds to the tape width, so that the relation between the tape width and the condition at which characters will be printed becomes easy to grasp, thus improving ease with which the tape printer can be operated.

The tape printer may further comprise: determination means for determining whether the tape width detected by the tape width detection means is changed; display continuation command means for, when a change in tape width is detected by the determination means, commanding production of display dot image data of the tape width of before the detected tape width change until a key of the input means is operated, whereupon the display continuation command means commands update of the display dot image data.

With this structure, the determination means determines whether the tape width detection means detects a change in the tape width during input of character data into the data memory means. When the determination means determines a change in tape width, until another key is operated the display continuation command means causes the display data production means to produce the same display dot image data from prior to the change in tape width. New display dot image data is produced after a key is operated.

That is, the determination means allows determining changes in tape width during input of character data. Unless another key is operated, the display continuation command means produces the display dot image data of before the tape width change so that the character display is maintained. After exchange of the tape is completed, updated display dot image data will be produced according to the new tape width when another key is operated. Therefore, distortion generated in the display image by changes in ON and OFF detection signals produced by the tape width detection means can be prevented, thus producing a stabler display image.

According to another aspect, the present invention provides a tape printer for printing desired characters onto a tape, comprising: input means for inputting characters desired to be printed on a tape and a variety of commands; data memory means for storing data of the inputted characters; a font memory for storing dot pattern data for a plurality of characters in a plurality of sizes; tape cassette receiving means for being detachably loaded with a tape cassette containing a tape; tape width detection means for detecting a tape width of the tape contained in the tape cassette loaded in the tape cassette receiving means; display condition data memory means for storing a plurality of predetermined display magnification rates in correspondence with tape widths, with widths of effective display ranges at which characters are to be displayed, and with display character sizes; display magnification rate setting means for selectively setting a display magnification rate; display data production means for determining the display character size and the width of the effective display range based on the data for the tape width detected by the tape width detecting means, on the data of the display magnification rate set by the display magnification rate setting means, and on the data of the display condition data memory means, for retrieving from the font memory means dot pattern data at the determined display character size for the characters stored in the data memory means, for producing display image data for displaying in the width of the effective display zone an image of characters that appears the same as the characters will appear when printed out, and for developing the display image data; a display data buffer for storing the developed display image data; display means for receiving the display image data from the display data buffer and for displaying the image of the inputted characters on the effective display zone of the determined width; and printing means for printing the image of the inputted characters on the tape.

With this structure, the tape width detection means detects the width of the tape in the tape cassette. The display condition data memory means contains a plurality of predetermined display magnification rate settings stored in correspondence to tape widths, display character sizes, and the widths of the effective display zone in which characters are actually displayed on the display. The rate at which displayed characters are magnified can be selectively set using the display magnification rate setting means.

The display data production means determines the display character size and the width of the effective display zone based on data about the tape width detected by the tape width detection means, based on the display magnification rate data set by the display magnification rate setting means, and based on the data from the display condition data memory means. The display data production means retrieves dot pattern data for characters stored in the data memory means and at the display character size determined from the font memory means. The display data production means then produces display image data for displaying in the effective display zone of the display the same image as will appear when the characters are printed out on the tape presently mounted in the tape printer. The display image data is developed in the display data buffer.

That is, a plurality of display magnification rates are stored in correspondence to display condition data such as tape widths, display character sizes, and widths of effective display zones. The display character size of characters and the width of the effective display zone are determined based on the display condition data, based on the tape width detected by the tape width detection means, and based on the display magnification rate selected via the display magnification rate setting means. The characters can then be displayed within the width of the display's effective display zone.

Characters can be displayed within an effective display zone and at a display character size which both correspond to the width of the tape mounted in the tape printer. Moreover, many different character sizes can be displayed using the plurality of display magnification rates.

Accordingly, an operator can gain a grasp of how images will appear when printed out on a certain width tape. Also, display of characters can be enlarged as necessary. Therefore, operations become much easier for inputting character data to be printed.

In the tape printer, the plurality of display magnification rates may include a base magnification rate for displaying characters in a size that is substantially proportional to the tape width, a double display magnification rate for displaying characters in a size that is about double the size produced by the base magnification rate, and a triple display magnification rate for displaying characters in a size that is about triple the size produced by the base magnification rate.

With this structure, by setting the base magnification rate, characters can be displayed at a display character size that is proportional to the width of the tape. By setting the double magnification rate, characters can be displayed at a display character size that is about twice the character size produced by the base magnification rate. Further, by setting the triple magnification rate, characters can be displayed at a display character size that is about three times the character size produced by the base magnification rate. In this way, the desired display magnification rate can be selected.

In the tape printer, the printing means may include: print data production means for receiving dot pattern data of a print character size from the font memory means for the characters stored in the data memory means, the print character size corresponding to the tape width, and for producing print image data representing the image of the inputted characters; and print control means for receiving the print image data and for printing the image of the inputted characters onto the tape.

With this structure, the font memory is constructed to function as a display font memory and as a print font memory. Therefore, both display dot image data and print dot image data can be produced from character dot pattern data retrieved from the font memory. Therefore, the font memory becomes much less expensive to produce.

According to a further aspect, the present invention provides a tape printer for printing desired characters onto a tape, the tape printer comprising: input means for inputting characters desired to be printed on a tape and a variety of commands; data memory means for storing data of the inputted characters; a font memory for storing dot pattern data for a plurality of characters in a plurality of sizes, tape cassette receiving means for being detachably loaded with a tape cassette containing a tape; tape width detection means for detecting a tape width of the tape contained in the tape cassette loaded in the tape cassette receiving means; display data production means for receiving data on the detected tape width, for retrieving dot pattern data of a display size from the font memory means for the characters stored in the data memory means, the display size corresponding to the tape width, and for producing display dot image data representing an image of the inputted characters which appears the same when displayed as when printed; a display data buffer for storing the produced display dot image data; display means for receiving the display dot image data from the display data buffer and for displaying the image of the inputted characters; and printing means for printing the image of the inputted characters on the tape, wherein the display data production means updates the display dot image data when the tape width detected by the tape width detection means changes.

BRIEF DESCRIPTION OF THE DRAWINGS

The above and other objects, features and advantages of the invention will become more apparent from reading the following description of the preferred embodiments taken in connection with the accompanying drawings in which:

FIG. 4 is a table showing correspondence relationship between cassette signals and tape width;

FIG. 5 is a table showing character sizes (in dots) of character fonts stored in the CGROM;

FIG. 6 is a table showing relationships between the tape width, printable width, the number of rows to be printed, and the printed character size;

FIG. 7 is a table showing relationships between the printed character size, the displayed character size, and magnification rates;

FIG. 8 is a table showing relationships between the tape width, zone widths, and magnification rates;

FIG. 21(*b*) is a flow chart showing the remainder of the main routine shown in FIG. 21(*a*);

FIG. 22 is a flowchart showing an interrupt routine according to a second preferred embodiment of the present invention for controlling change of the displayed image when the print tape is exchanged.

DETAILED DESCRIPTION OF THE PREFERRED EMBODIMENT

Figure 1:
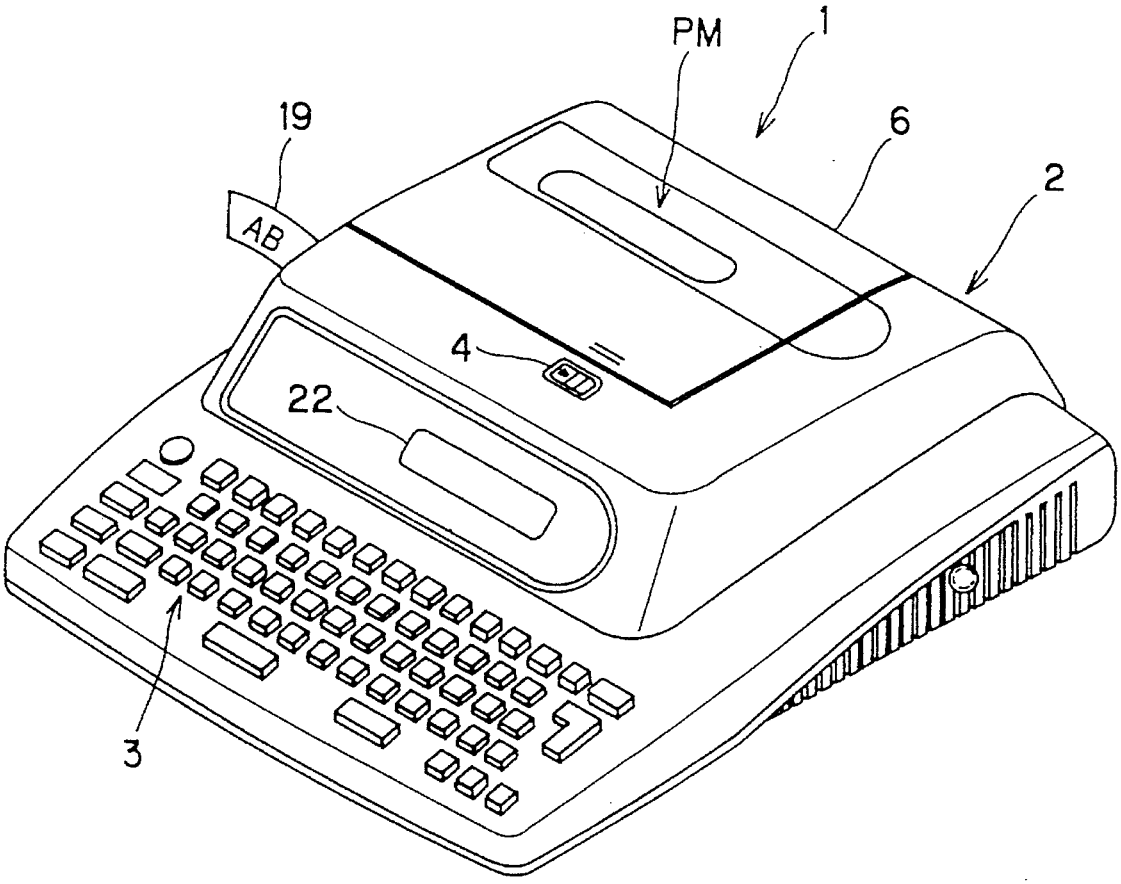
FIG. 1 is a perspective view showing a tape printer according to a first preferred embodiment of the present invention.

A tape printer according to preferred embodiments of the present invention will be described while referring to the accompanying drawings wherein like parts and components are designated by the same reference numerals to avoid duplicating description. In the preferred embodiments, the present invention is applied to a tape printer capable of printing various alphanumeric letters and symbols (referred to generically as characters hereinafter) onto a print tape.

As shown in FIG. 1, in a tape printer according to a first preferred embodiment of the present invention, a keyboard 3 is disposed in front of a body frame 2 of a tape printer 1, a printing mechanism PM is provided at the rear of the keyboard 3 and within the body frame 2, and a liquid crystal display 22 capable of displaying inputted characters as print-like images is disposed just behind the keyboard 3. The display unit 22 has a screen composed on 32 dots in the vertical direction high and 121 dots in the horizontal. A release button 4 is provided for opening a cover frame 6 when a tape containing cassette CS is to be loaded in or removed from a printing mechanism PM.

On the keyboard 3 there are arranged a variety of keys as character keys for inputting characters of a desired text to be printed; a space key; a return key; cursor moving keys for moving a rectangular cursor K horizontally and vertically on the display 22; a display size setting key; format setting keys for changing and setting format information on character enhancement, the character size at which characters are to be displayed and to be printed, and the like; an enter key for entering each of various setting processes; a print key for commanding printing operations; and a power key for turning power on and off.

The printing mechanism PM will be described in detail while referring to FIG. 2A. The rectangular, tape containing cassette CS is removably loaded in the printing mechanism PM. Within the tape containing cassette CS, there are rotatably provided a tape spool 8 around which a transparent laminate film 7 is wound; a ribbon supply spool 10 around which a print ribbon 9 is wound; a take-up spool 11 for taking up the print ribbon 9; a supply spool 13 around which a double-coated tape 12 with the same width as the laminate film 7 is wound with its peel-off paper on the outside; and a joining roller 14 for adhering the double-coated tape 12 to the laminate film 7. The double-coated tape 12 includes a base tape, on both sides of which are formed adhesive layers, and a peel-off paper attached to the adhesive layer on one side of the base tape.

A thermal head 15 is installed upright in the position where the laminate film 7 and the print ribbon 9 overlap each other. A platen roller 16, for pressing the laminate film 7 and the print ribbon 9 against the thermal head 15, and a feed roller 17, for pressing the laminate film 7 and the double coated tape 12 against the joining roller 14 to thereby form the print tape 19, are pivotally supported for rotation on a support member 18 which is pivotally rotatably mounted on the body frame 2. On the thermal head 10 15, there is provided a group of heating elements formed of a train of 128 heating elements arranged in the vertical direction.

Accordingly, when electric current is passed through the heating elements while the joining roller 14 and the take-up spool 11 are driven in their predetermined rotation directions in synchronism with each other by rotation of a tape feed motor 45 (refer to FIG. 3) in its predetermined rotating direction, characters (including bar codes and other symbols) are printed on the laminate film 7 using plural trains of dots. Then, the double coated tape 12 is attached to the laminate film 7 and the tape is fed, as the print tape 19, in the tape feeding direction A to be discharged from the body frame 2 as shown in FIGS. 1 and 2A. Details of the printing mechanism PM are described in U.S. Pat. No. 5,188,469, the disclosure of which is hereby incorporated by reference.

Figure 2A:
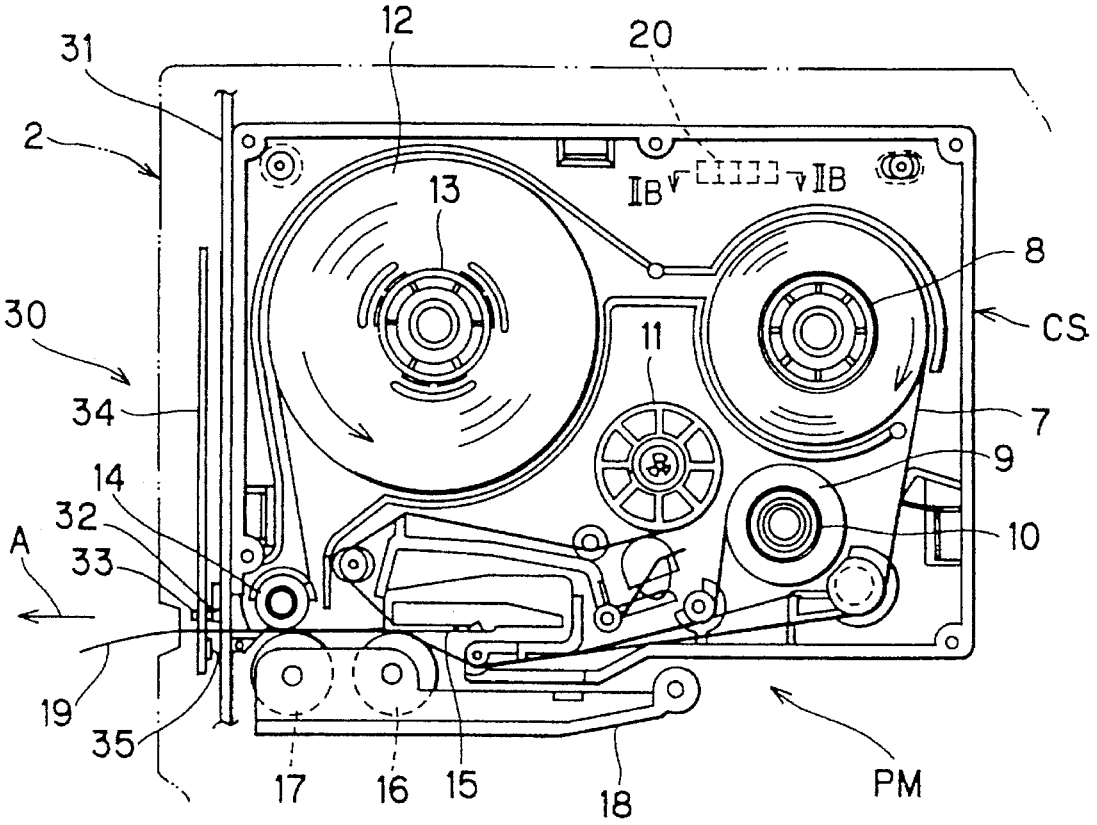
FIG. 2A is a schematic plan view of a print mechanism employed in the tape printer, with a tape cassette loaded therein.

Referring to FIG. 2A, a manual cutting mechanism 30 for cutting the print tape 19 will be described in detail below. Just inside the body frame 2, there is provided a plate-formed auxiliary frame 31 in an upright posture and a stationary blade 32 that is fixedly attached to the auxiliary frame 31 so as to face in an upward direction. An operating lever 34 extended in the direction from front to rear is rotatably supported at its portion closed to the front end of the tape printer on a pivot shaft 33 that is fixedly attached to the auxiliary frame 31. A movable blade 35 is fixedly attached to the operating lever 34 in front of the pivot shaft 33 such that it opposes the stationary blade 32. The rear end portion of the operating lever 34 is structured so as to be vertically swingable via a swing drive mechanism (not shown) that is coupled to a cutting motor 46 (see FIG. 3). Normally, the movable blade 35 is held apart from the stationary blade 32.

The print tape 19 having text printed thereon passes through the space between the stationary blade 32 and the movable blade 35 and sticks out of the body frame 2. Then, a cut signal drives the cutting motor 46 to cause the swing drive mechanism to vertically swing the rear end of the operation level 34. The swinging motion causes the moving blade 35 to approach the fixed blade 32 so as to cut the print tape 19.

The print tape 19 to be fed from the tape containing cassette CS (i.e., the double-coated tape 12 and the laminate film 7 mounted in the cassette CS) is provided in five different widths: 6 mm, 9 mm, 12 mm, 18 mm, and 24 min. 0n the bottom wall 21 of each tape containing cassette CS, there is provided a projecting piece 20. The projecting piece 20 formed on each tape cassette CS is for indicating a tape width of a tape 19, i.e., the width of the double-coated tape 12 and the laminate film 7, that is mounted in the cassette CS. Because the tape width is one of the five tape widths, the projecting piece 20 formed on each tape cassette CS is formed with four projecting claws for distinguishing in combination one from the five tape widths.

Figure 2B:
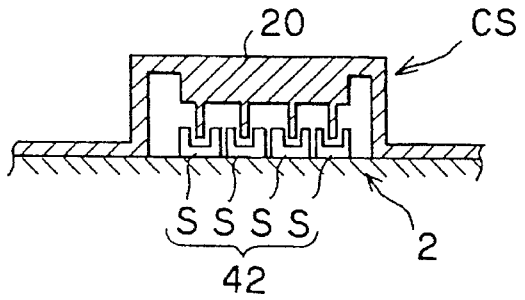
FIG. 2B is a schematic sectional view taken along a line IIB—IIB of FIG. 2A.

As shown in FIG. 2B, a cassette sensor 42 is provided on the body frame 2 at a position with which the projecting piece 20 of the tape cassette CS will be brought into confrontation when the tape cassette CS is loaded in the printing mechanism portion PM. The cassette sensor 42 is for detecting the condition of the projecting claws of the projecting piece 20 to thereby detect the tape width of a tape 1 housed in the tape cassette CS that is loaded in the printing mechanism portion PM.

The cassette sensor 42 is made from four photocouplers S, each having a light-emitting diode paired with a photodetector. Each of the four photocouplers is located at a position capable of receiving a corresponding projecting claw of the projecting piece 20. Each photosensor is therefore for detecting whether or not the corresponding projecting claw is inserted between the light-emitting diode and the photodetector. Illustratively, the cassette sensor 42 outputs a cassette signal "0100" for a tape width of 24 mm, a cassette signal "1100" for a tape width of 12 mm, or a cassette signal "0000" when not tape cassette CS is mounted.

Figure 3:
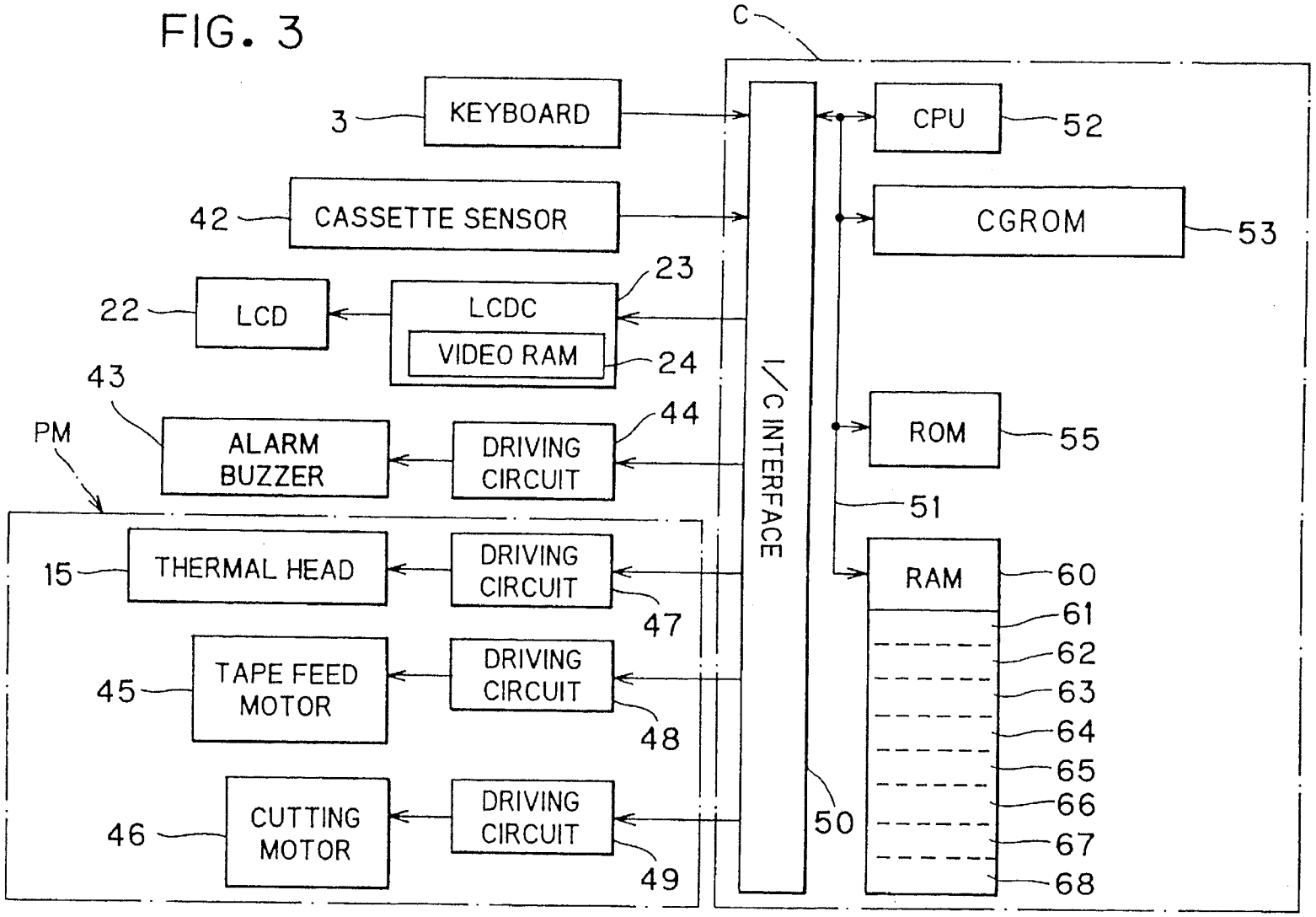
FIG. 3 is a block diagram showing a control system for the tape printer.
Figure 9:
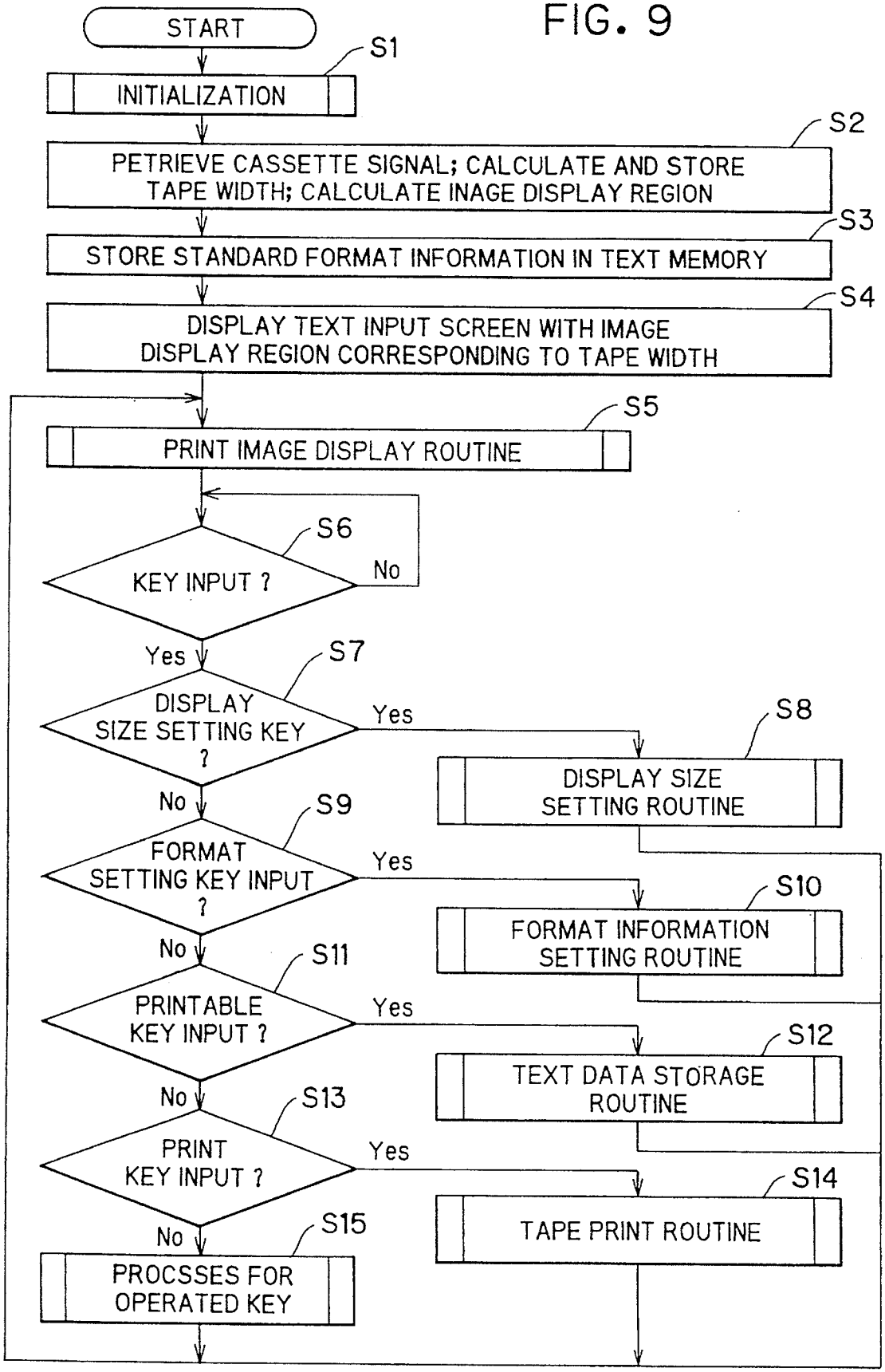
FIG. 9 is a flowchart showing a main routine of the tape print control.

The-control system of the tape printing apparatus 1 is constituted as shown in the block diagram of FIG. 3.

A control unit C includes a CPU 52 and a I/O interface 50, a CGROM (character generator ROM) 53, a ROM 55 and a RAM 60 which are connected to the CPU 52 via a bus 51 such as a data bus.

The I/O interface 50 of the control unit C is connected to the keyboard 3; the cassette sensor 42; an LCD controller 23, with a video RAM 24, for outputting display data to the LCD unit 22; a driving circuit 44 for activating an alarm buzzer 43; a driving circuit 47 for driving the thermal head 15; a driving circuit 48 for driving the tape feed motor 45; and a driving circuit 49 for driving the cutting motor 46.

The CGROM 53 stores dual display/print dot pattern data as character font data with respect to code data of each of a plurality of characters in correspondence to each of nine (that is, 7, 10, 16, 21, 24, 32, 48, 64, and 96 dot) sizes at which characters are to be displayed and are to be printed (i.e., display character sizes and print character sizes), and each of a plurality of fonts (such as Gothic, Ming type, etc), as shown in FIG. 5.

In the ROM 55 are prestored a control program for displaying on the display 22 characters that are inputted on the keyboard 3 and for afterward printing the characters on tape; a print drive control program for serially retrieving data from a print data buffer 65 and for driving the tape feed motor 45, the thermal head 15, and the like; and the Tables TB1 and TB3 through TB5 shown in FIGS. 4 and 6 through 8.

In the ROM 55 are also stored a search table in which the nine character sizes shown in Table TB2 (FIG. 5) are listed in correspondence with the start addresses (index address) of the CGROM 53 indicating where dot pattern data is stored for a group of characters and symbols for one character size; and an index table in which the index addresses are listed in correspondence with the start addresses stored in the CGROM 53 for each character and symbol.

In the RAM 60, a text memory 61 accommodates text data input from the keyboard 3. A parameter buffer 62 stores a start address pointer value SP for designating a start address in the text memory 61; an end address pointer value EP for designating an end address in the text memory 61; and data count values DC. In the location information memory 63 is stored display position information for the location in the display data buffer 64 of each character and symbol to be displayed.

In the display buffer 64 is stored display dot image data, which is synthesized from the display dot pattern data of a plurality of inputted characters. In the print data buffer 65 is stored print dot image data, which are synthesized from print dot pattern data for a plurality of characters to be printed. In the tape width memory 66 is stored tape width data on the width of the tape housed in the presently mounted tape cassette CS as determined based on the cassette signal from the cassette sensor 42 and on the Table TB1. In the display magnification memory 67 is stored data on the display magnification rate R. Initialization sets the display magnification rate R to "1" but the display magnification rate R can be changed using the display size setting key. A work memory 68 is also provided in the RAM.

Next, an explanation of Tables TB1 through TB5 will be provided. FIG. 4 shows Table TB1, which is for determining the tape width of the tape in the tape cassette CS mounted in the tape printer 1 according to the detection signal from the cassette sensor 42.

FIG. 5 shows Table TB2, which indicates character sizes for character fonts stored in the CGROM 53 (i.e., dual display/print dot pattern data), the range of character sizes to be used as print font, and the range of character sizes to be used as display font. FIG. 6 shows Table TB3, which presets the size at which characters are to be printed print character size) in points (each point corresponding to a certain number of dots) in correspondence with tape width, number of dots printable across the width of the tape, and the number of rows or lines of character strings printable on the tape. Once the tape width and the number of rows to be printed are set, this table is used to determine the print character size.

FIG. 7 shows Table TB4, which sets character display sizes in correspondence with print character sizes (in points) and with three magnification rates (base magnification rate, 2×, and 3×) for display character size (in dots). For example, the print character size is determined using Table TB3 based on the tape width and the number of rows to be printed. The display character size is then determined using the Table TB4, as based on the display magnification rate R and the print character size.

FIG. 8 shows Table TBS, which stores data on width (in dots) of various display zones in correspondence with tape widths and display magnification rates R. Data is stored for width of the lower cutoff zone of the display 22, the image display zone (i.e., effective display zone) of the display 22, and the upper cutoff zone of the display 22.

As shown in Table TB5 in the section titled "REMARKS," the image display zone in the display 22 is the effective display zone where characters are displayed. The width of the image display zone changes depending to the width of the tape. The upper cutoff zone and the lower cutoff zone are shadowed out by slanted lines on the display 22 and are unused for display of images. Because both the width of the image display zone and the display character size increase with increase in the tape width, characters can be displayed within the width of the image display zone in an image that appears virtually the same as the printed image of the characters will appear.

Next, an explanation of a main routine performed by the control device C of the tape printer 1 for controlling printing of tapes will be provided while referring to the flow charts in FIGS. 9 through 12, wherein the reference numbers Si (i=1, 2, 3, . . . ) in the figures refer to separate steps in the routine. This control routine is started when the power is turned on by depressing the power key on the keyboard 3. The memories 61 through 68 of the RAM 60 are cleared, and initialization processes for initializing the print mechanism PM are executed (S1). Next, the cassette signal from the cassette sensor 42 is read. The tape width is determined based on the cassette signal and information indicated in Table TB1. The data on the tape width is stored in the tape width memory 66. The width of the image display zone is calculated based on the tape width and the information indicated in Table TB5 (S2).

Next, data including information on the standard format (such as the number of rows to be printed, the print character size, and font) is stored in the first 2 bytes of the text memory 61 (S3). For example, the number of rows to be printed is set to 1 and the font is set to Ming-cho typeface. The print character size is set based on the tape width, the number of rows to be printed ("1" in this example), and the information in the Table TB3.

Next, a text input screen and a cursor K (refer to FIG. 19) are displayed on the display 22 (S4). The text input screen has the image display zone that corresponds to the tape width calculated in S2. The cursor K is displayed at the same size as the display character size determined based on the print character size, the base magnification rate, and the information in Table TB4. During display of this text input screen, data for the widths of the lower cutoff zone, the image display zone, and the upper cutoff zone is retrieved from the Table TB5 for the base magnification rate and the present tape width. Based on this data the upper cutoff zone and the lower cutoff zone are shadowed out by slanted lines. Display dot image data is developed in the display data buffer 64 and the data is displayed.

Next, the print image display routine for displaying characters and symbols stored in the text memory 61 on the display 22 as a print image are executed (S5). An explanation of the print image display routine will be provided later.

Next, whether data is inputted using a key is determined (S6). If not, S6 is repeated until data is inputted using a key (i.e., until S6 is YES), whereupon the program proceeds to S7.

Figure 12:
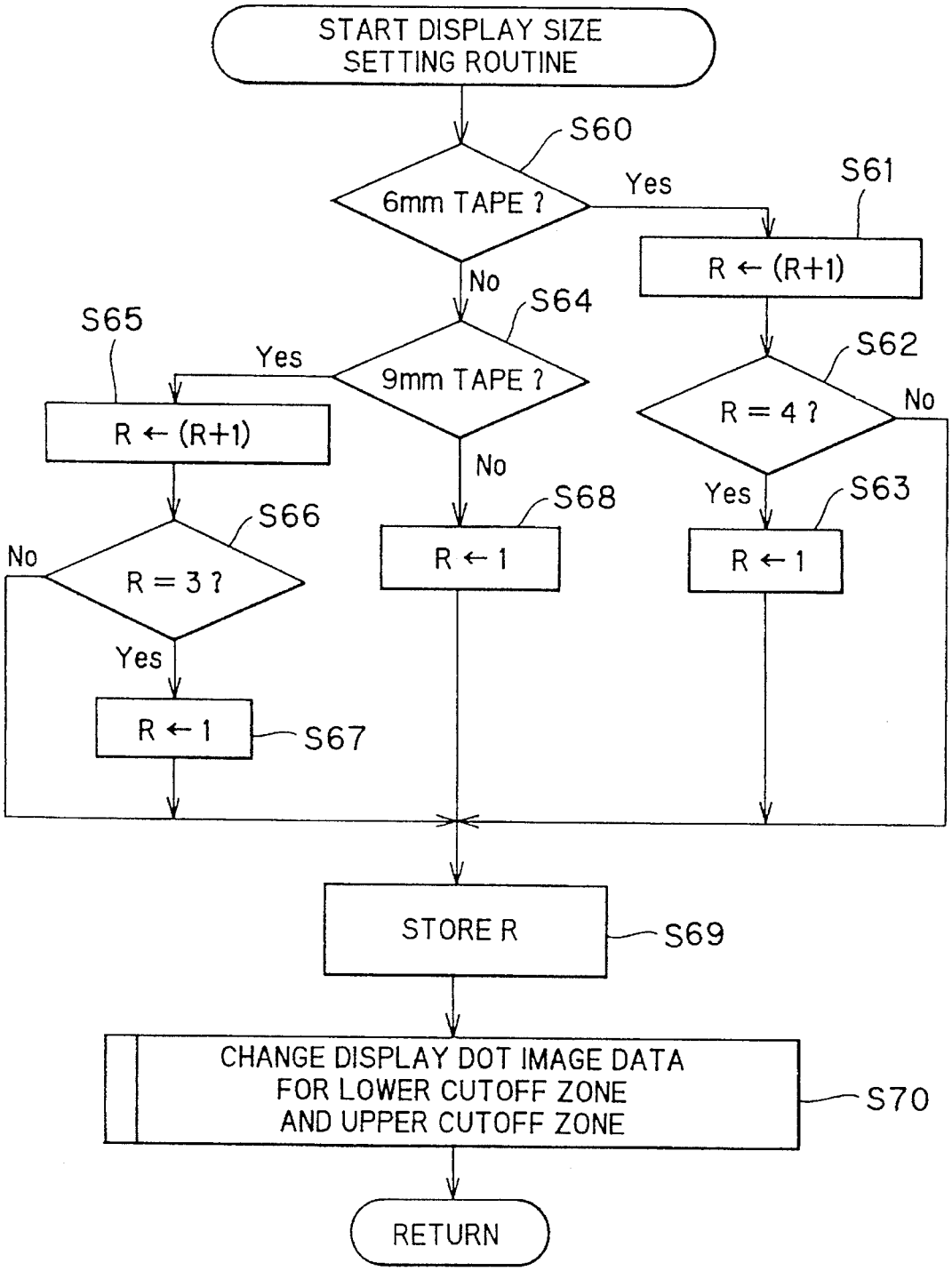
FIG. 12 is a flowchart showing display size setting routine of the main routine shown in FIG. 9.

When the display size setting key is manipulated for changing the display magnification rate at which characters are displayed on the display 22 (i.e., S7 is YES), a display size setting routine is executed (S8), The display size setting routine will be described while referring to FIG. 12.

As mentioned above, data on the tape width is stored in the tape width memory 66 and data on the present display magnification rate R is stored in the display magnification memory 67. Determinations of S60, S62, S64, and S66 are executed based on these sets of data.

At first, when the tape width is 6 mm (i.e., S60 is YES), the display magnification rate R is incremented by "1" (S61). When S61 raises the display magnification rate to "4" (i.e., S62 is YES), the display magnification rate R is reset to "1" (S63). That is, when the tape width is 6 mm, characters appear small when displayed at the base magnification. However, because a great deal of margin is available for enlarging the display, the display magnification rate R can be changed between the base magnification rate ("1"), the double magnification rate ("2"), and the triple magnification rate ("3"). The data for the display magnification rate R is then stored in the display magnification rate memory 67 (S69).

On the other hand, when the tape width is 9 mm (i.e., S60 is NO and S54 is YES), the display magnification rate R is incremented by "1" (S65). When S65 raises the display magnification rate R to "3" (i.e., S66 is YES), the display magnification rate R is reset to "1" (S67). That is, when the tape width is 9 mm, only a small margin remains for enlarging the display of characters. Therefore, the display magnification rate R can be changed only between the base magnification rate ("1") and the double magnification rate ("2"). The data for the display magnification rate R is then stored in the display magnification rate memory 67 (S69).

When the tape width is 12 mm or greater. (i.e., S60 and S64 are NO), no room remains on the screen for enlarging display of characters. Therefore, the display magnification rate R is fixed at "1" (the base magnification rate) in S68. Data for the base magnification rate (i.e., display magnification rate R of "1") is stored in the display magnification rate memory 67 (S69). Next, display dot image data for the lower cutoff zone and the upper cutoff zone is changed according to the change in the display magnification rate and then developed in the display data buffer 64 (S70). After display size setting routine is completed, the program returns to S5.

When the format setting key is manipulated during the main routine (i.e., S9 is YES), the format information setting control routine is executed (S10). Afterward the program proceeds to S5. During the format information setting routine, the LCD unit 22 displays a format setting screen in which all format settings including the number of rows to be printed, the print character size, and font name may be designated. With the format setting screen displayed, the cursor move keys are operated to set the cursor consecutively to appropriate positions of categories such as "PRINT CHARACTER SIZE NAME" and "FONT NAME." At each item to which the cursor is set, appropriate numeric keys are operated to enter the desired setting, after which the enter key is pressed. The format information is stored in the text memory 61 as updated format information. The updated format information including the information on changed settings is stored as two bytes in the text memory 61 in succession with the standard format information (refer to FIG. 13). Next, the program proceeds to S5.

Next, when a printable key such as for a character is manipulated (i.e., S11 is YES), text data storage routine for storing the code data for the manipulated printable key in the text memory 61 as text data are executed (S12). Afterward the program proceeds to S5 where a print image display routine are executed (S5).

Figure 10:
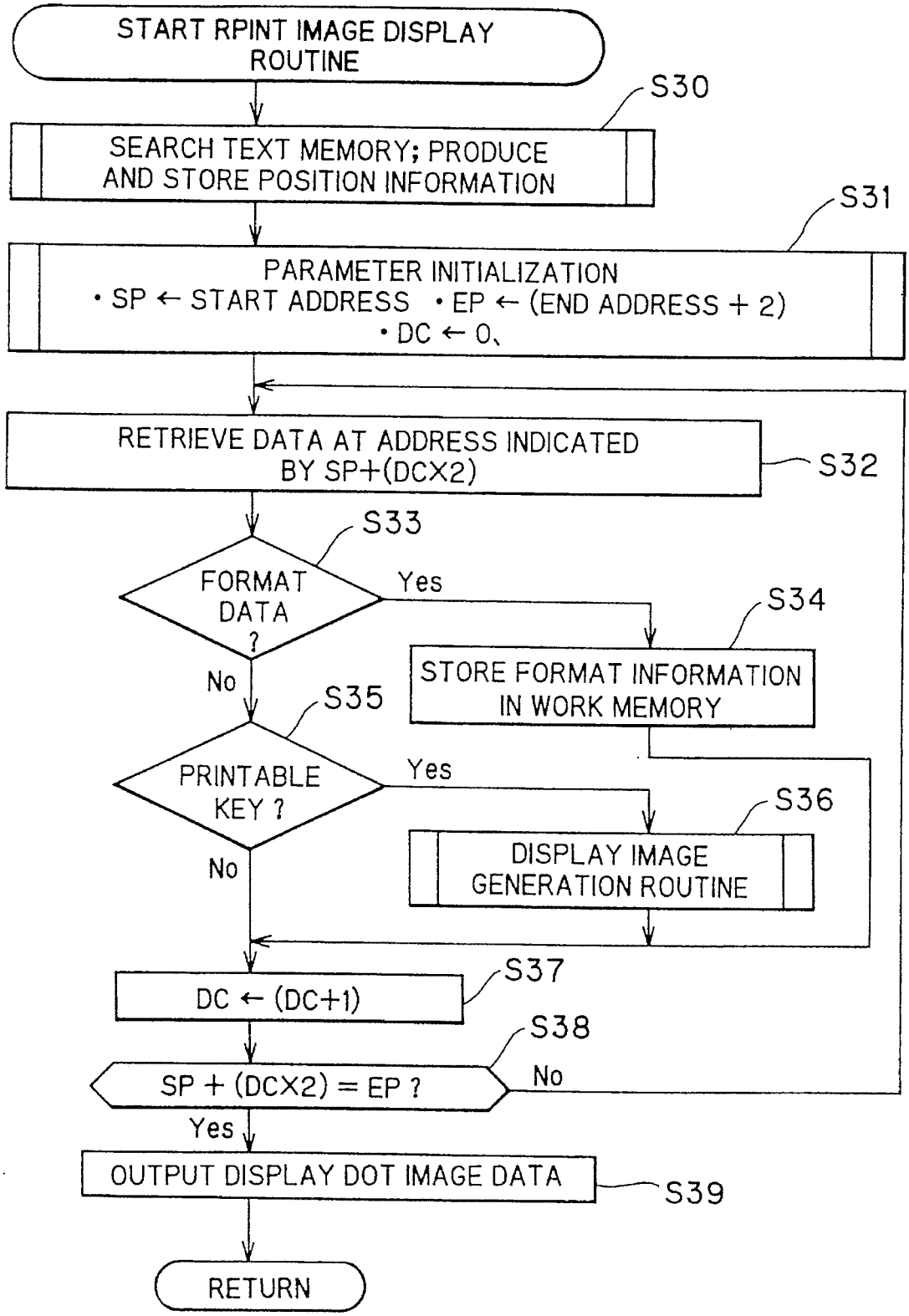
FIG. 10 is a flowchart showing print image display routine of the flowchart shown in FIG. 9.
Figure 11:
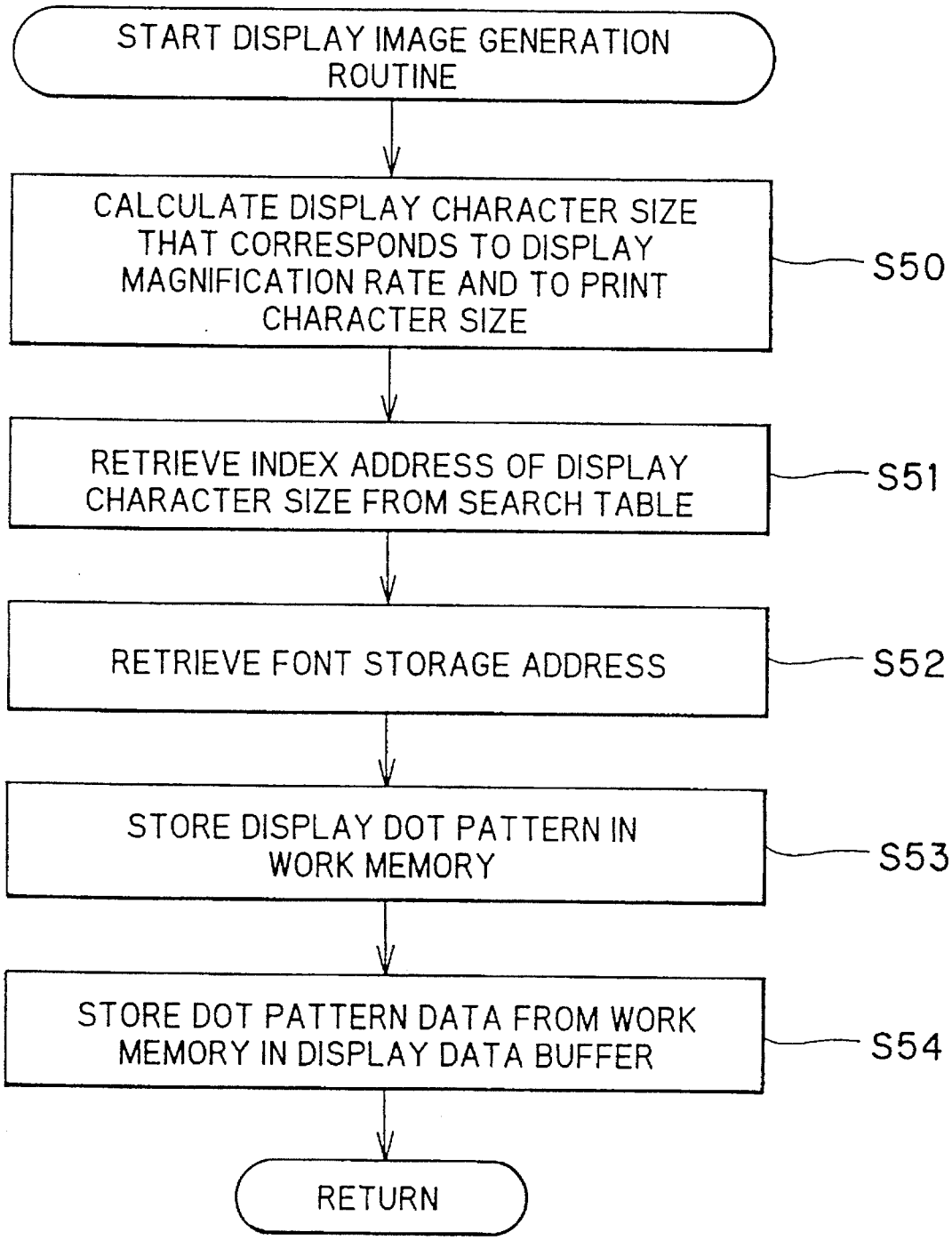
FIG. 11 is a flowchart showing display image generation routine of the routine shown in FIG. 10.
Figure 13:
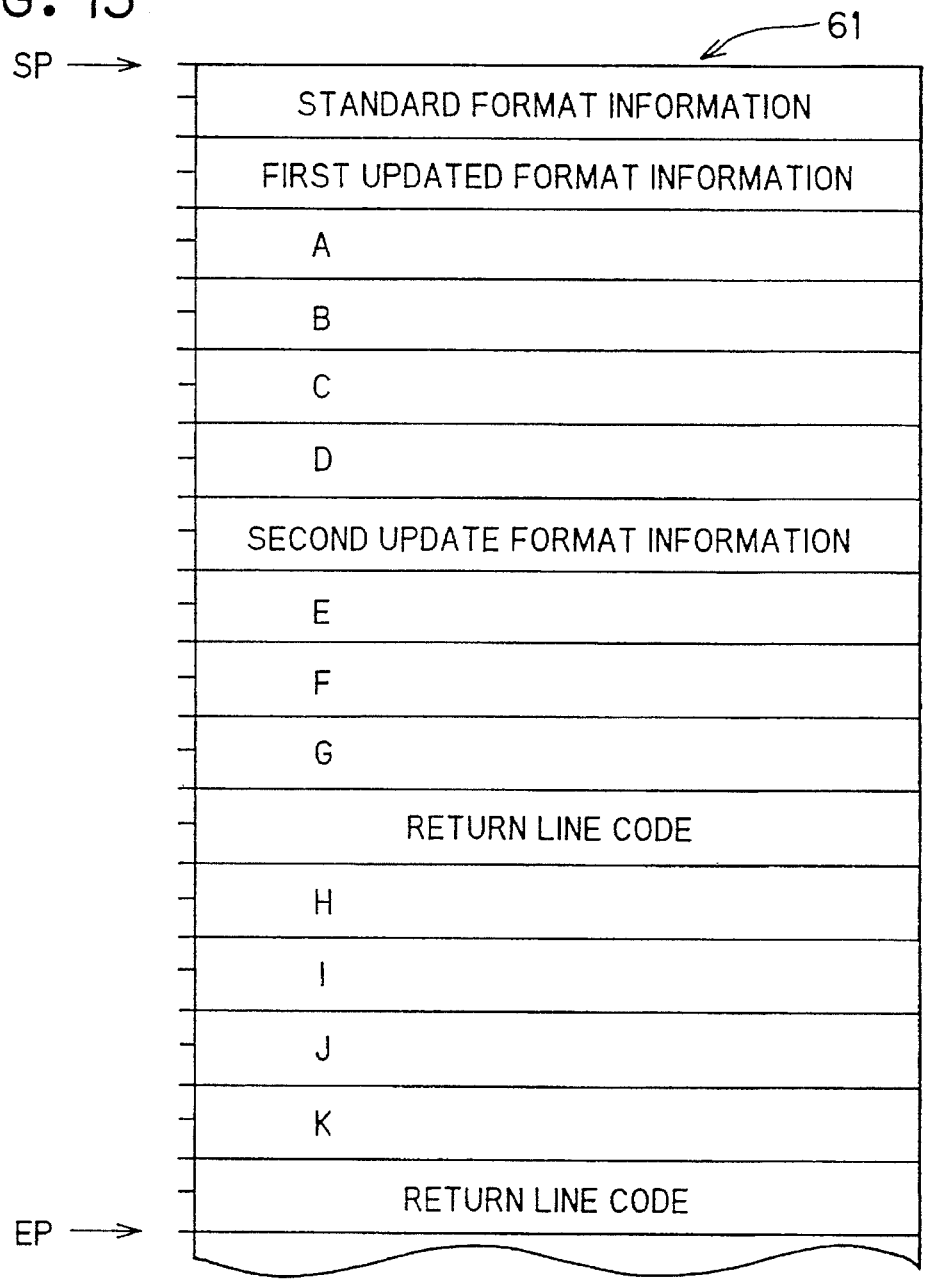
FIG. 13 is an explanatory diagram showing text memory in which a plurality of text information, strings of character codes, and the like are stored.
Figure 14:
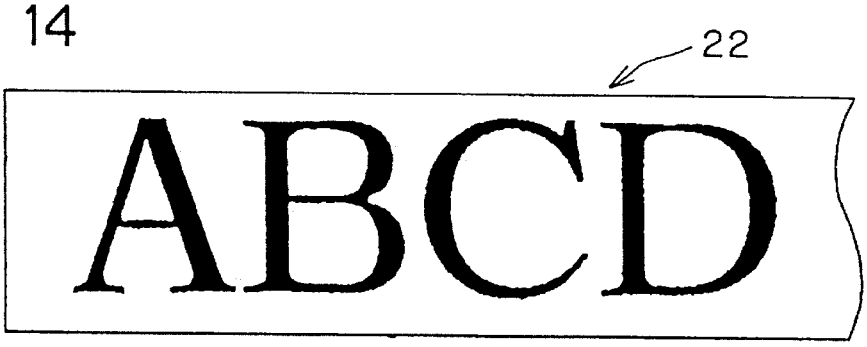
FIG. 14 is an explanatory diagram showing an example of a display when the tape cassette mounted in the tape printer houses a 24 mm wide tape.
Figure 15:
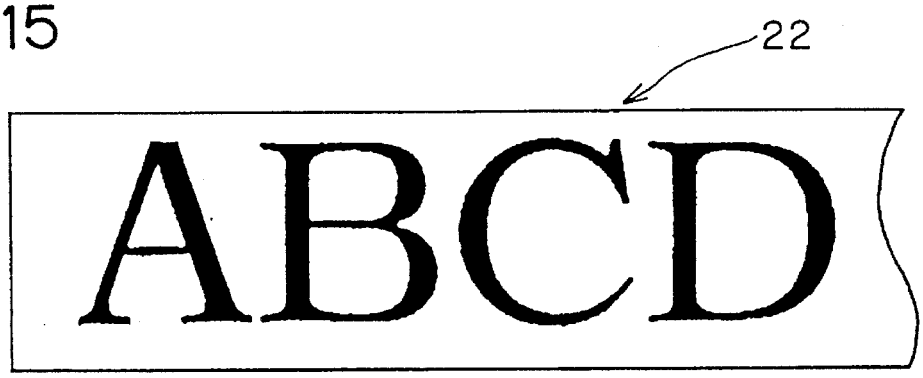
FIG. 15 is an explanatory diagram showing an example of a display when the tape cassette mounted in the tape printer houses a 18 mm wide tape.
Figure 16:
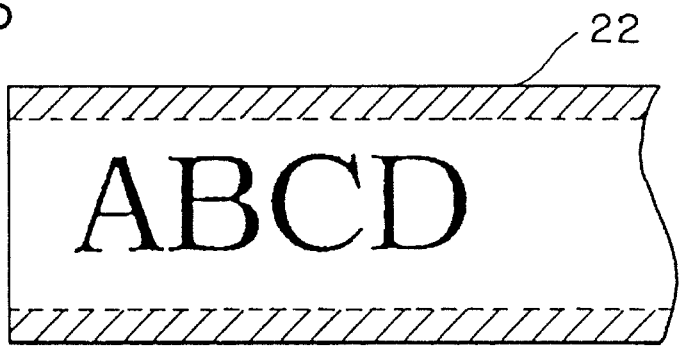
FIG. 16 is an explanatory diagram showing an example of a display when the tape cassette mounted in the tape printer houses a 12 mm wide tape.
Figure 17:
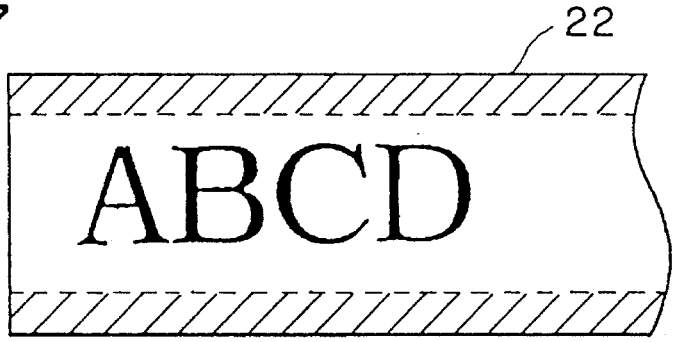
FIG. 17 is an explanatory diagram showing an example of a display when the tape cassette mounted in the tape printer houses a 9 mm wide tape.
Figure 18:
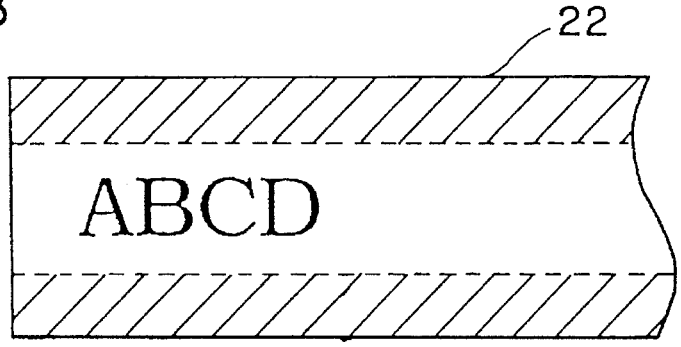
FIG. 18 is an explanatory diagram showing an example of a display when the tape cassette mounted in the tape printer houses a 6 mm wide tape.

An explanation of the print image display routine will be provided while referring to FIGS. 10 and 11. During this time, the standard format information, first updated format information, characters "ABCD", second updated format information, and the like are serially stored in the text memory 61 as shown in FIG. 13. When this control routine starts, data in the text memory 61 is serially searched from the start address. Information on locations in the display data buffer 64 for developing display dot pattern data for each of the displayed characters is determined. The location information is stored in the location information memory 63 (S30) . The location information is determined by, for example, determining the character position for printing based on the print dot pattern data, the return code, the character code, and the format information, and multiplying the coordinate values of the determined character position by ⅓ so as to determine display position.

Next, parameter information for printing processes are initialized in the parameter memory 62 (S31). That is, the start address pointer value SP in the parameter memory 62 is set to the start address of the text memory 61 (refer to FIG. 13). The address pointer value EP in the parameter memory 62 is set to the address that is two bytes after the present end address (i.e., the present end address +2). (refer to FIG. 13). An initial value "0" is set as the data count value DC.

Because format information and character codes are each composed of two bytes, the search address is defined as the sum of the start address plus two times the data count value DC. The search address is first stored in the start address (S32). When the data stored in the start address is format information (i.e., YES in S33), the format information data is stored in the work memory 68 (S34). Afterward, the program proceeds to S37. When the data retrieved from the search address is data for a space or a printable character (i.e., S33 is NO and S35 is Yes), a display image generation routine is executed (S36) and the program proceeds to S37.

Next, the data count value DC is incremented by one (S37) . When the search address data does not match the address indicated by the end address pointer value EP, which means that a displayed character still exists in the text memory 61 (i.e., S38 is NO), S32 through S38 are again executed.

Next, an explanation of display image generation routine executed in S36 will be provided while referring to FIG. 11. When this control routine is started, the display character size of the character to be displayed is determined based on the print character size SZ from the format information stored in the work memory 68 in S34, on the display magnification rate R in the display magnification rate memory 66, and on the information in Table TB4 (S50). The index address in the CGROM 53 where dot pattern data for the determined character size is located is retrieved based on the display character size and the search table (S51). Further, based on the index table and the retrieved index address, the start storage address (i.e., font storage address) in the CGROM 53 is retrieved for the character code of the character to be displayed (S52). The dot pattern data stored in the retrieved font storage address is retrieved from the CGROM 53 and stored in the work memory 68 (S53).

Next, the dot pattern data now in the work memory 68 is stored at the location in the display data buffer 64 indicated by the location data of the location information memory 63 for the character to be displayed (S54). This routine is then completed and the program returns to S37 of the print image display control routine.

Next, in the print image display routine, when after execution of S37 the search address (i.e., the sum of the start pointer and double the data count) matches the address indicated by the end address pointer value EP (i.e., S38 is YES), the display dot image data developed and stored in the display data buffer 64 is outputted to the video RAM 24 and displayed on the display 22 (S39). This control routine is then completed and the program returns to the main routine S6.

Next, in the main routine, when the print key is manipulated (i.e., S13 is YES), the tape print routine for causing printing of the displayed characters on the tape is executed (S14) and the program returns to S5. Because the tape print routine includes standard printing processes, the following explanation will be brief. The character codes, font information, and the like are sequentially retrieved from the text memory 61. Dot pattern data for the character codes is retrieved from the CGROM 53 based on the search table and the index table, developed in the print data butter 65 and stored. Print dot image data in the print data buffer 66 is outputted to the print mechanism PM and printing is performed on the print tape 19 accordingly. On the other hand, when a key other than the print key, a printable key, the format setting key, or the display size setting key 13 is manipulated (i.e., S13 is NO), processes corresponding to the manipulated key are executed (S15) and the program returns to S5.

FIGS. 14 through 18 show examples of the display 22 when the base display magnification rate is applied to text data for the character string "ABCD" inputted to the text memory 61 as indicated in FIG. 13. FIGS. 14 through 18 represent images displayed for tape widths of 24 mm, 18 mm, 12 mm, 9 mm, and 6 mm respectively.

Figure 19:
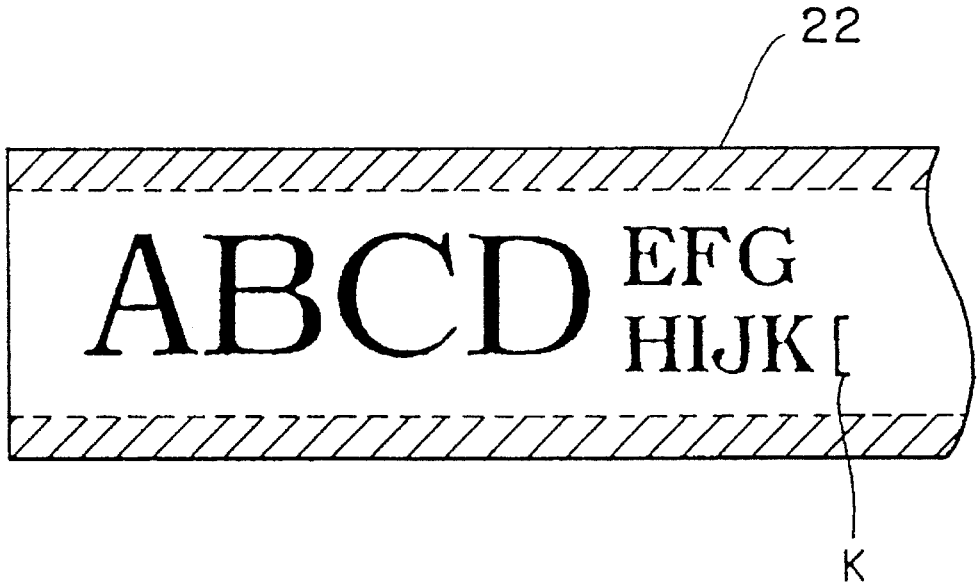
FIG. 19 is an explanatory diagram showing an example of a display when the tape cassette mounted in the tape printer houses a 9 mm wide tape.

However, when data for all character strings "ABCD", "EFG", and "HIJK" is inputted, the character strings "EFG" and "HIJK" are displayed on two separate rows as shown in FIG. 19. The cursor K is shown in the figures.

Figure 20:
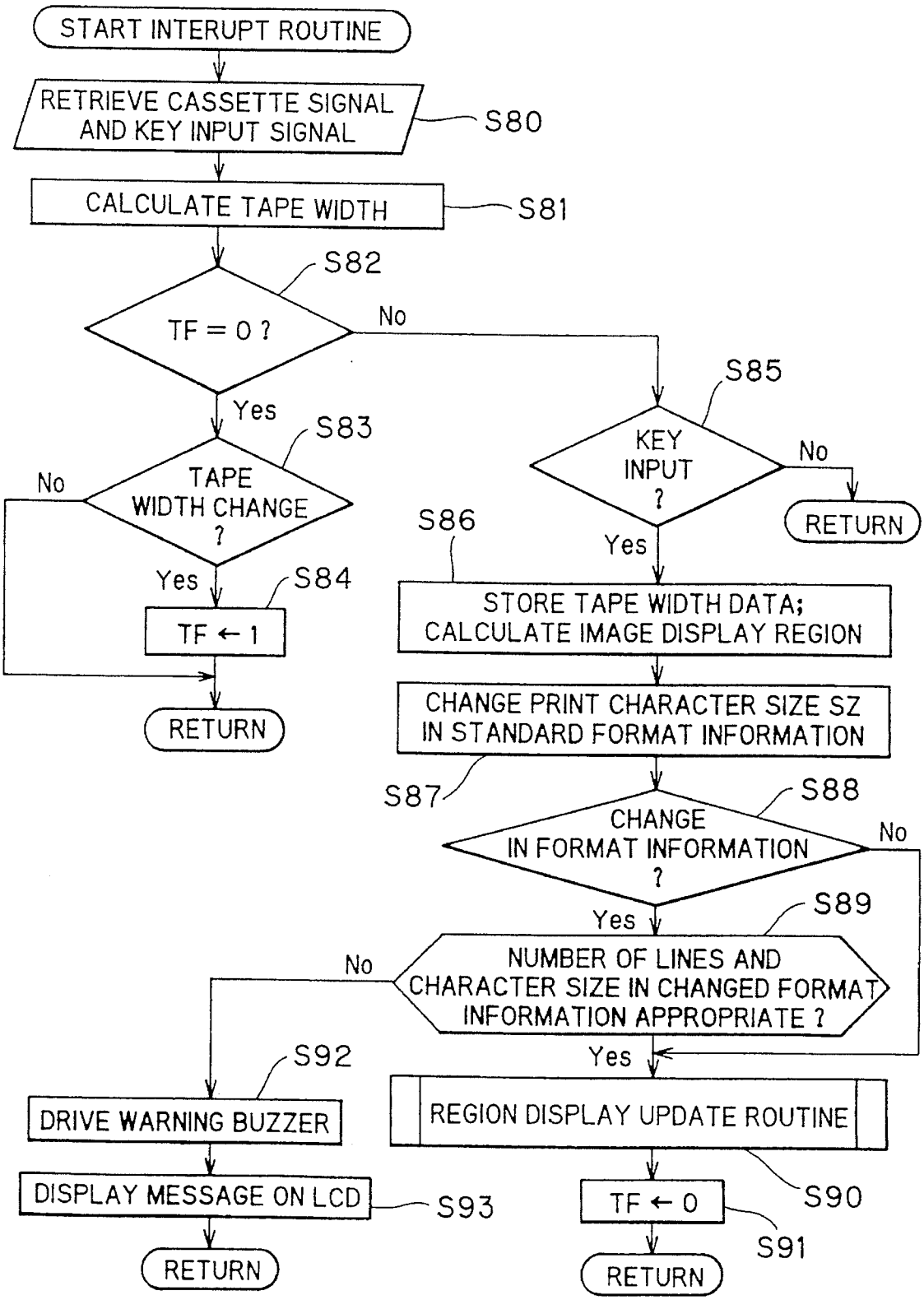
FIG. 20 is a flowchart showing an interrupt routine for controlling change of the displayed image when the print tape is exchanged.

The interrupt routine for changing the display when the tape, that is, the tape cassette CS, is exchanged during production of text data for one document will be explained while referring to the flowchart shown in FIG. 20. This interrupt routine is executed at predetermined microsecond intervals during the, main routine, At the start of the interrupt routine cassette signals from the cassette sensor 42 and key input signals are retrieved (S80). Next, the tape width is calculated based on the cassette signals as described above (S81). Whether the flag TF is "0" is determined in (S82). When the tape cassette CS is not being exchanged, the flag TF will be "0" so that the program proceeds to S83, where whether the tape width has changed or not is determined. If not, (i.e., S83 is NO), the program returns to the main routine. If so (i.e., S83 is YES), the flag TF is set to "1" and the program returns to the main routine.

During the next run of the interrupt routine, that is, after the flag TF is set to "1," S82 will be NO so that the program proceeds to S85, where whether key input is present is determined If not, (i.e., S85 is NO), the program returns to the main routine.

The flag will be "1" during the next run of the interrupt routine. If key input is also present (i.e., S85 is YES), the program proceeds from S85 to S86, where data on the changed tape width is stored in the tape width memory 66 and where the width of the image display zone is calculated based on the tape width and the table TB5 (S86). Next, in the same manner as performed in S3, data on the print character size SZ indicated by the standard format information in the text memory 61 is updated to the print character size that corresponds to the tape width (S87).

If there is updated format information (i.e., S88 is YES), whether the number of print lines and the print character size of the updated format information are appropriated for the new tape width in the tape width memory 66 is determined (S89). If appropriate (i.e., S89 is YES), the upper cutoff zone and the lower cutoff zone of the display dot image data is changed so that the image display zone corresponds to the tape width (S90). Then the flag TF is reset to "0" (S91) and the program returns to the main routine. When no updated format information is present (i.e., S88 is NO), S90 and on are executed.

On the other hand, when S89 is NO, the warning buzzer 43 is driven (S92) and a predetermined message (such as "UPDATE FORMAT INFORMATION") is displayed (S93), and afterward the program returns to the main routine.

In this way, during production of text data, after the tape width is changed by exchanging a tape cassette CS, the image displayed on the display 22 will not change until after exchange of the tape cassette CS is completed and after a key is operated. Then, the width of the image display zone and the data of the print character size SZ of the standard format information are changed to values that correspond to the tape width. Therefore, display character size at which characters are displayed is changed to correspond to the updated character size, and the characters of the image displayed on the display 22 are changed to the new display character size.

As described above, according to the present invention, the print character size is basically set substantially in proportion to the width of the tape, in accordance with Table 3. The display character size is set substantially in proportion to the print character size. Because the display character size is thus set substantially in proportion to the tape width, the relation between the tape width and the condition in which the characters will be printed is easy to grasp so that operability is improved.

An upper cutoff zone and a lower cutoff zone respectively of the upper portion and the lower portion of the display 22 are shadow out when displayed. The width of the image display zone, that is, the width of the central portion in the width direction of the display 22, is set substantially in proportion to the width of the tape. Characters are displayed in the image display zone in an image that appears the same as the printed image. Therefore, the relationship between the tape width and the printed characters printed on the tape can be accurate and quickly grasped. This increases operability when text data is inputted. Mistakes such as incorrectly inputting the print character size can be prevented.

According to the present invention, the size at which characters are displayed, that is, the display magnification rate, can be enlarged using the display size setting key. Therefore, characters can be displayed on the display 22 at an enlarged size if necessary. For example, when a narrow tape is housed in the tape cassette or when a plurality of rows are inputted, display can be enlarged, thereby facilitating reading of the characters.

Further, as explained with reference to FIG. 20, when tape width is changed during input of text data for one document, the image displayed on the display 22 is updated only after the tape cassette CS is exchanged and after a key is operated. Therefore, the image on the display 22 will not become distorted by changes in the ON and OFF signals produced when the tape cassette CS is exchanged.

Next, a description of a tape printer according to a second preferred embodiment of the present invention will be provided. External appearance and structure of the tape printer including its control system according to the second preferred embodiment are similar to those of the tape printer described in the first preferred embodiment, except that a tape width setting key is additionally provided to the keyboard 3.

Figure 21A:
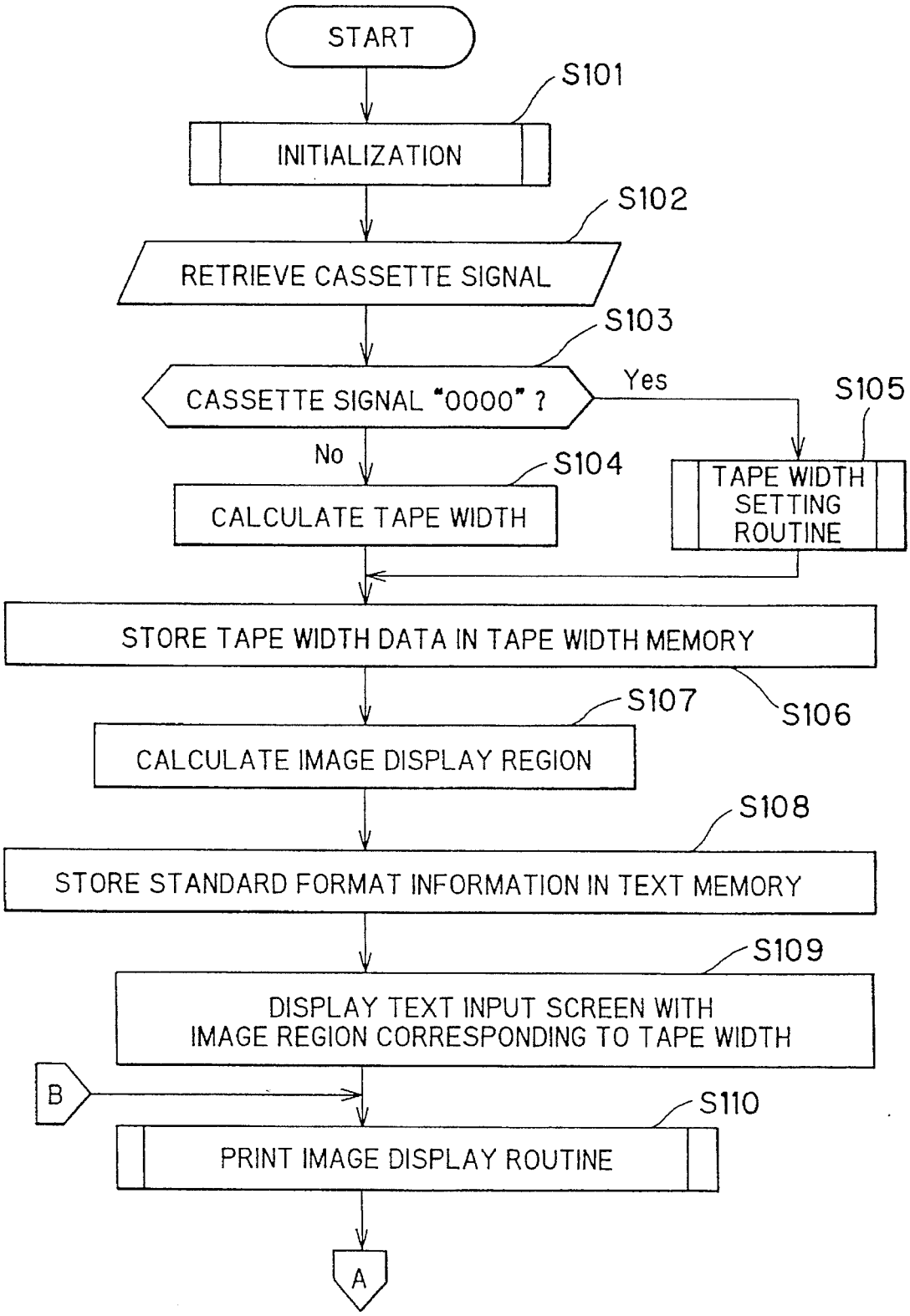
FIG. 21(*a*) is a flowchart showing a portion of a main routine for controlling tape printing operations according to a second preferred embodiment of the present invention.
Figure 21B:
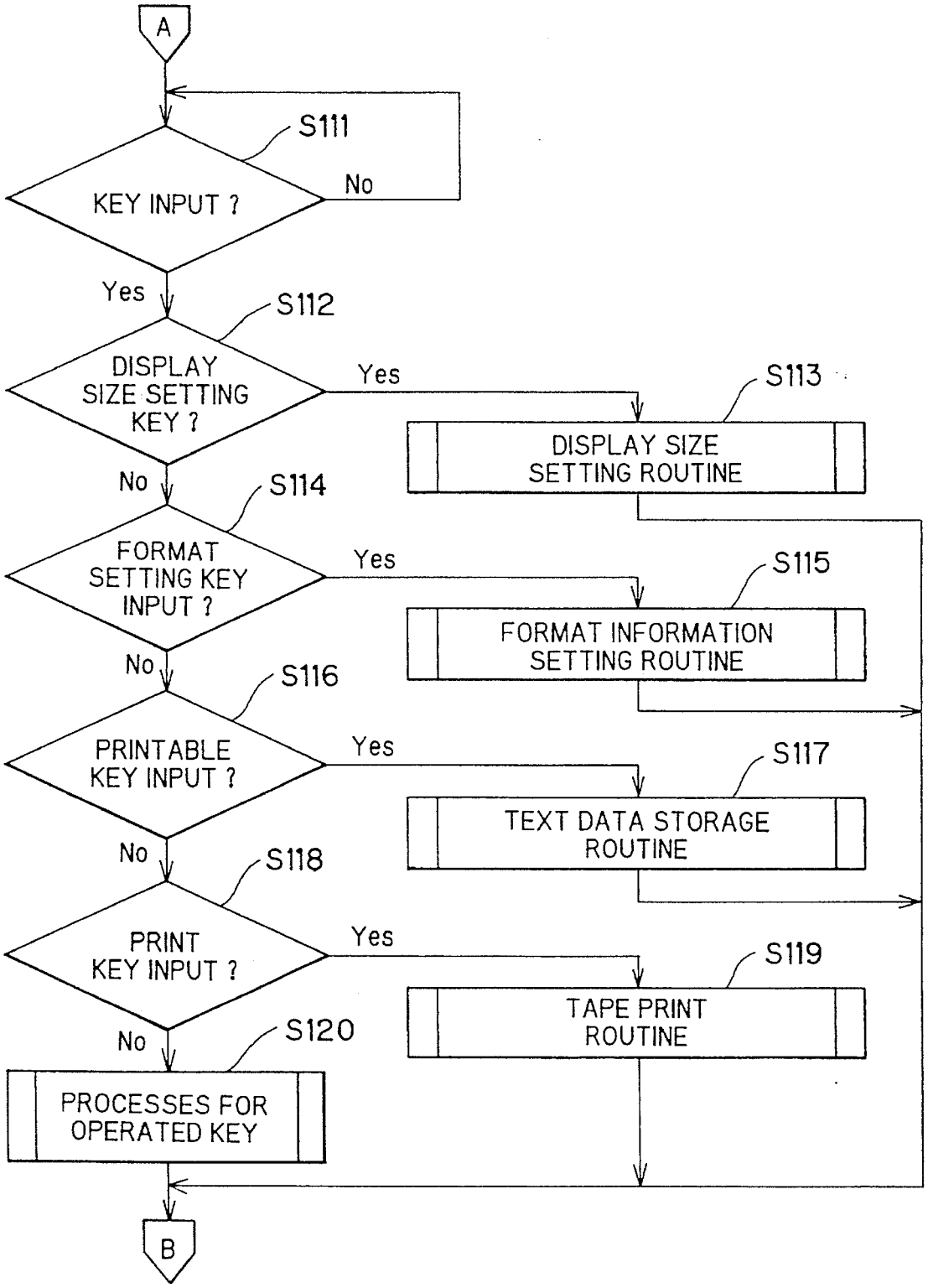

The main control routine performed by the control device C for printing on tape using the tape printer 1 according to the second preferred embodiment will be explained while referring to the flowcharts in FIGS. 21(*a*), 21(*b*), and 10 through 12.

This main control routine is started when the power is turned on using the power key on the keyboard 3. First, the memories 61 through 68 in the RAM 60 are cleared and the print mechanism is initialized (S101). Next, the cassette signal is read from the cassette sensor S2 (S102). Whether the cassette signal is "0000" is determined (S103). When the cassette signal is determined not to be "0000," which means a tape cassette CS is mounted in the tape printer (i.e., S103 is NO), then the tape width of the tape in the tape cassette is calculated based on the cassette signal and table TB1 (S104).

Figure 23:
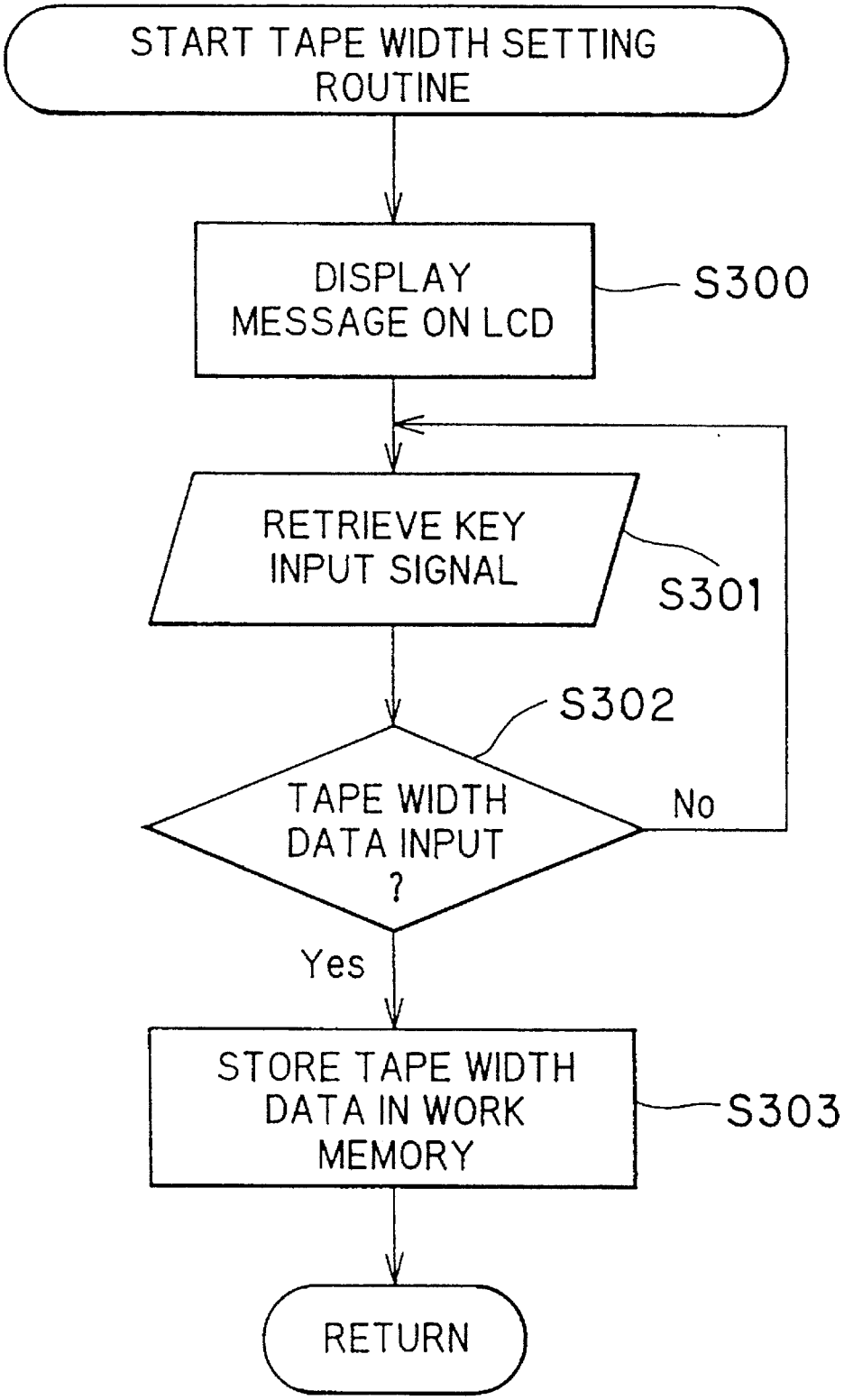
FIG. 23 is a flowchart showing a tape width setting routine of the routine shown in FIG. 22.

On the other hand, when a tape is not mounted in the tape printer, so that the cassette signal is "0000" (i.e., S103 is YES), the tape width setting routine of S105 is executed. The tape width setting routine can be set up so that the tape width is automatically set to the maximum tape width (i.e., 24 mm in this embodiment) and so that the data on the maximum tape width is stored in the work memory. Setting the tape width to the maximum tape width in this way minimizes risk that errors will be caused by restrictions in the tape width. Alternatively, the tape width setting routine can be set up as shown in the flowchart of FIG. 23 so that the desired tape width is set when inputted by the operator. In this case, a predetermined message (such as "INPUT TAPE WIDTH") is first displayed on the display (LCD) 2 (S300). Next, input signals from keys are read (S301). Whether tape width data has been inputted is determined (S302). When an operator inputs and sets the tape width using the tape width setting key and the numeric keys, the routine proceeds to S303, where the data on the tape width is stored in the work memory.

Next, in S106 of the main routine, the data calculated in S104, or the data on the tape width stored in the work memory in S105, is stored in the tape width memory 66. Next, the width of the image display zone is calculated based on the table TB5 and on the tape width stored in the tape width memory 66 (S107).

Next, S108 through S120, which correspond to S3 through S15 in the first preferred embodiment, are sequentially executed.

The routine for controlling change of display when tape is exchanged, that is, when the tape cassette CS is exchanged when producing text data of one document, will be explained while referring to flowchart shown in FIG. 22. This interrupt routine is executed at predetermined microsecond intervals during the main routine. At the start of the interrupt routine, first, cassette signals and key input signals are read from the cassette sensor 42 (S280). Whether the cassette signal is "0000" is determined (S281). If a tape cassette CS is mounted in the tape printer so that the cassette signal is not "0000" (i.e., S281 is NO), the tape width is calculated based on the cassette signal and the table TB1, and the resultant tape width data is stored in the work memory (S282).

On the other hand, when no tape cassette CS is mounted in the tape printer, and the cassette signal is therefore "0000" (i.e., S281 is YES), a tape width setting routine is performed in S283. The tape width setting routine can be set up so that, as described for S105, the tape width is automatically set to the maximum tape width and the data on the maximum tape width stored in the work memory. Alternatively, the tape width setting routine can be set up so that, as shown in FIG. 23, tape width data set as inputted by an operator is stored in the work memory. After S283, processes in S284 through S289 are executed in the same manner as corresponding S82 through S87 of the first preferred embodiment.

When updated format information is present (i.e., S290 is YES), whether the number of print lines and the print character size of the updated format information are appropriate for the tape width is determined based on the tape width data stored in the tape width memory 66 (S291). If so (i.e., S291 is YES), the display dot image data for the upper cutoff zone and the lower cutoff zone is changed so that the image display zone corresponds to the actual tape width (S292). Next, the flag TF is reset to "0" (S293) and the program returns to the main routine. When no updated format information exists (i.e., S290 is NO), S292 and on are executed.

On the other hand, when a NO determination is made in S291, the warning buzzer 43 is driven (S294) and a predetermined message (such as "SET NEW FORMAT INFORMATION") is displayed on the display 22 (S295). Afterward, the program returns to the main routine.

In this way, during input of text data for one document, after tape width is changed, either by the tape cassette CS being exchanged with a different tape cassette CS or by the tape cassette CS being removed from the tape printer, only after the tape cassette CS is exchanged or removed and after a key is operated will the width of the image display zone and the data on the print character size SZ of the standard format information be changed to correspond to the new tape width, whereupon the display character size is changed to correspond to the new print character size, and the image displayed on the display 22 is updated according to the new display character size.

As described above, in the display control routine including tape print control routine according to the second preferred embodiment, print character sizes are stored in Table TB3 in correspondence with tape width and number of print lines; display character sizes are stored in Table TB4 in correspondence with print character size and three predetermined magnification rate, (i.e., base magnification rate, double magnification rate, and triple magnification rate) for the display image; and the width of zone where image is displayed (effective display zone), the width of the upper cutoff zone of the effective display zone, and the lower cutoff zone of the effective display zone are stored in Table TB5 in correspondence with tape width and the three predetermined magnification rates. Also, the widths of the display character size and the image display zone are set in the base magnification rate to be substantially proportional to the tape width. The display character size and the width of the image display zone are determined based on the tape width detected by the cassette sensor 42 and based on the display magnification rate set using the display size setting key. Characters are displayed within the image display zone of the display 22 as the print image at the display character size. Therefore, the relation between the tape width and the image at which characters will be printed out can be easily grasped by viewing the display 22, at the base magnification rate.

The display magnification rate can be switched between a base magnification rate, a double magnification rate, and a triple magnification rate. Therefore when the tape width is narrow, when several print lines are displayed, or other situation where the display character size becomes too small to see clearly, the display character size and the width of the image display can be magnified but left substantially proportional to the tape width, thereby facilitating input of text data.

Moreover, the upper cutoff zone and the lower cutoff zone respectively at the upper and lower portions of the display 22 are displayed shadowed out. In the central portion (in the vertical direction) of the display 22 is displayed an image display zone (effective display zone) with a width substantially proportional to the tape width, Therefore, an understanding of the tape width can be easily grasped by viewing the display 22.

As in S103 and S105 of the main routine, when there is no tape cassette CS mounted in the tape printer from the start, the tape is automatically set to the maximum tape width or to a tape width set by input from an operator. Therefore, even when no tape cassette C8 is mounted in the tape printer, text data can be inputted in the same manner as when a tape cassette CS is mounted in the tape printer. Risk of errors being caused by tape width restrictions are thereby minimized, especially when the maximum tape width is automatically set. Setting the tape width by input from an operator is advantageous because the tape width can be set for the tape on which printing is expected to be performed.

Further, as explained with reference to FIG. 22, when the tape width is changed, for example by exchanging or removing the tape cassette CS, during input of text for one document, the image displayed on the display 22 is updated only after the tape cassette CS is exchanged and after a key is operated. Therefore, the image on the display 22 will not become distorted by changes in the ON and OFF signals produced when the tape cassette CS is exchanged. In this way, ease of operability and the reliability of the tape printer are improved.

Instead of the cassette sensor 42, a detection means wherein the tape width is directly detected by an optical sensor and the like installed along the tape transport path can be used. Instead of shadowing out the upper cutoff zone and the lower cutoff zone, the upper cutoff zone and the lower cutoff zone of the display 22 can be separated from the image display by an appropriate border line. A display CGROM and an independent print CGROM can be provided in place of a CGROM 53. The present invention is also applicable to tape printers with a large thermal head for printing on tapes with widths of 24 mm or larger. Also, the display 22 can be made to the width of the largest tape width or greater and characters displayed at the same size as printed characters. The data on number of print lines can be left out from the format information, and the number of print lines can be determined based on carriage return codes at the end of character strings.

As described above, according to the above-described embodiments, after initialization (S1), the cassette signal is retrieved (S2). Then the tape width of the tape in the tape cassette mounted in the tape printer is determined by tape TB1 (S4). The width of the image display zone is calculated using the tape width and using the table TB5 (S7). The data of standard format information is stored in the start address of the text memory (S8). A text input screen is displayed set with the image display zone corresponding to the tape width calculated in S2 for the display. A cursor is also displayed having the size of the display character size, which has been determined based on the print character size, which was calculated using the tape width, the number of lines "1," and the table TB3. Accordingly, it becomes possible to provide a grasp of the relation between tape width and the situation at which characters will be printed.

Additionally, an interrupt routine is executed at predetermined microsecond intervals. A cassette signal is retrieved from the cassette sensor (S80). The tape width is calculated (S81). If the tape width is changed (i.e., S83 is YES), the flag TF is set to "1" (S84). If a key is operated during the next run of the interrupt routine (i.e., S85 is YES), the width of the image display zone is calculated based on the updated tape width (S86). If there is updated format information (i.e., S88 is YES), and if updated format information is appropriated for the new tape width (i.e., S89 is YES), the upper cutoff zone and the lower cutoff zone of the display dot image data is changed so that the image display zone corresponds to the tape width (S90). Accordingly, it becomes possible to provide a grasp of the relation between tape width and the situation at which characters will be printed and also to provide a stable display image even when the tape cassette is being exchanged.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A tape printer for printing desired characters onto a tape, the tape printer comprising:

input means for inputting characters desired to be printed on a tape and a variety of commands;

data memory means for storing data of the inputted characters;

font memory means for storing dot pattern data for a plurality of characters in a plurality of sizes;

tape cassette receiving means for being detachably loaded with a tape cassette containing a tape;

tape width detection means for detecting a tape width of the tape contained in the tape cassette loaded in the tape cassette receiving means;

display data production means for receiving data on the detected tape width, for retrieving dot pattern data of a display size from the font memory means for the characters stored in the data memory means, the display size corresponding to the tape width, and for producing display dot image data representing an image of the inputted characters which appears the same when displayed as when printed;

a display data buffer for storing the produced display dot image data;

display means for receiving the display dot image data from the display data buffer and for displaying the image of the inputted characters; and printing means for printing the image of the inputted characters on the tape.

2. A tape printer as claimed in claim 1 further comprising: size enlarging setting means for setting an enlarged display size at which characters are to be enlarged when displayed, the display data production means retrieving from the font memory means dot pattern data of the enlarged display size which is set by the size enlarging setting means.

3. A tape printer as claimed in claim 2 wherein the display data production means updates the display dot image data when the tape width detected by the tape width detection means changes.

4. A tape printer as claimed in claim 3 further comprising display condition data memory means for storing a plurality of predetermined display magnification rates in correspondence with tape widths, with widths of effective display ranges at which characters are to be displayed, and with display character sizes, wherein the display data production means determines the display character size and the width of the effective display range based on the data for the tape width detected by the tape width detecting means, on the data of the display magnification rate determined dependently on the setting by the size enlarging setting means, and on the data of the display condition data memory means retrieves from the font memory means dot pattern data at the determined display character size for the characters stored in the data memory means, produces display image data for displaying in the width of the effective display zone an image of characters that appears the same as the characters will appear when printed out, and develops the display image data.

5. A tape printer as claimed in claim 1, wherein the printing means includes:

print data production means for receiving dot pattern data of a print size from the font memory means for the characters stored in the data memory means, the print size corresponding to the tape width, and for producing print dot image data representing the image of the inputted characters; and print control means for receiving the print dot image data and for printing the image of the inputted characters onto the tape.

6. A tape printer as claimed in claim 1 further comprising:

determination means for determining whether the tape width detected by the tape width detection means is changed; and display continuation command means for, when a change in tape width is detected by the determination means, commanding production of display dot image data of the tape width of before the detected tape width change until a key of the input means is operated, whereupon the display continuation command means commands update of the display dot image data.

7. A tape printer for printing desired characters onto a tape, comprising:

input means for inputting characters desired to be printed on a tape and a variety of commands;

data memory means for storing data of the inputted characters;

font memory means for storing dot pattern data for a plurality of characters in a plurality of sizes;

tape cassette receiving means for being detachably loaded with a tape cassette containing a tape;

tape width detection means for detecting a tape width of the tape contained in the tape cassette loaded in the tape cassette receiving means;

display condition data memory means for storing a plurality of predetermined display magnification rates in correspondence with tape widths, with widths of effective display ranges at which characters are to be displayed, and with display character sizes;

display magnification rate setting means for selectively setting a display magnification rate;

display data production means for determining the display character size and the width of the effective display range based on the data for the tape width detected by the tape width detecting means, on the data of the display magnification rate set by the display magnification rate setting means, and on the data of the display condition data memory means, for retrieving from the font memory means dot pattern data at the determined display character size for the characters stored in the data memory means, for producing display image data for displaying in the width of the effective display zone an image of characters that appears the same as the characters will appear when printed out, and for developing the display image data;

a display data buffer for storing the developed display image data;

display means for receiving the display image data from the display data buffer and for displaying the image of the inputted characters on the effective display zone of the determined width; and printing means for printing the image of the inputted characters on the tape.

8. A tape printer as claimed in claim 7 wherein the plurality of display magnification rates includes a base magnification rate for displaying characters in a size that is substantially proportional to the tape width, a double display magnification rate for displaying characters in a size that is about double the size produced by the base magnification rate, and a triple display magnification rate for displaying characters in a size that is about triple the size produced by the base magnification rate.

9. A tape printer as claimed in claim 7 wherein the printing means includes:

print data production means for receiving dot pattern data of a print character size from the font memory means for the characters stored in the data memory means, the print character size corresponding to the tape width, and for producing print image data representing the image of the inputted characters; and print control means for receiving the print image data and for printing the image of the inputted characters onto the tape.

10. A tape printer for printing desired characters onto a tape, the tape printer comprising:

input means for inputting characters desired to be printed on a tape and a variety of commands;

data memory means for storing data of the inputted characters;

font memory means for storing dot pattern data for a plurality of characters in a plurality of sizes;

tape cassette receiving means for being detachably loaded with a tape cassette containing a tape;

tape width detection means for detecting a tape width of the tape contained in the tape cassette loaded in the tape cassette receiving means;

display data production means for receiving data on the detected tape width, for retrieving dot pattern data of a display size from the font memory means for the characters stored in the data memory means, the display size corresponding to the tape width, and for producing display dot image data representing an image of the inputted characters which appears the same when displayed as when printed;

a display data buffer for storing the produced display dot image data;

display means for receiving the display dot image data from the display data buffer and for displaying the image of the inputted characters; and printing means for printing the image of the inputted characters on the tape, wherein the display data production means updates the display dot image data when the tape width detected by the tape width detection means changes.

11. A tape printer as claimed in claim 10 further comprising:

determination means for determining whether the tape width detected by the tape width detection means is changed; and display continuation command means for, when a change in tape width is detected by the determination means, commanding production of display dot image data of the tape width of before the detected tape width change until a key of the input means is operated, whereupon the display continuation command means commands update of the display dot image data.

12. A tape printer as claimed in claim 10, wherein the printing means includes:

print data production means for receiving dot pattern data of a print size from the font memory means for the characters stored in the data memory means, the print size corresponding to the tape width, and for producing print dot image data representing the image of the inputted characters; and print control means for receiving the print dot image data and for printing the image of the inputted characters onto the tape.

* * * * *